United States Patent [19]

Hamakawa

[11] Patent Number: 4,723,148

[45] Date of Patent: Feb. 2, 1988

[54] COPYING APPARATUS EQUIPPED WITH ORIGINAL DOCUMENT FEEDING DEVICE

[75] Inventor: Wataru Hamakawa, Toyokawa, Japan

[73] Assignee: Minolta Camera Kabushiki Kaisha, Osaka, Japan

[21] Appl. No.: 832,470

[22] Filed: Feb. 19, 1986

[30] Foreign Application Priority Data

Feb. 20, 1985 [JP] Japan ..... 60-33154
Feb. 28, 1985 [JP] Japan ..... 60-40609

[51] Int. Cl.[4] ..... G03G 15/00

[52] U.S. Cl. ..... 355/14 SH; 355/3 R; 355/3 SH; 355/14 R

[58] Field of Search ..... 355/14 SH, 14 R, 14 C, 355/14 CU, 3 R, 3 SH, 23, 24; 271/186, 236, 245, 256, 257, 3, 3.1

[56] References Cited

U.S. PATENT DOCUMENTS 4,273,439 6/1981 Markham et al. ..... 355/14 C
4,338,023 7/1982 McGibbon ..... 355/14 SH
4,477,068 10/1984 Arter et al. ..... 271/186
4,508,447 4/1985 Doery ..... 355/14 SH

*Primary Examiner*—A. C. Prescott
*Attorney, Agent, or Firm*—Price, Gess & Ubell

[57] ABSTRACT

A copying apparatus equipped with an automatic duplexed original document feeding device, which is so arranged that, in the course of operation for an original document in an original document feeding path, after suspension of the operation, any remaining operation with respect to said original document can be rapidly and correctly resumed. The status of the copying operation is monitored and stored, and upon restoration of the copying cycle the document can be correctly positioned to continue the copying cycle as if the copying operation had never been interrupted.

21 Claims, 18 Drawing Figures

COPYING APPARATUS EQUIPPED WITH ORIGINAL DOCUMENT FEEDING DEVICE

BACKGROUND OF THE INVENTION

1. Field of the Invention

The present invention generally relates to a copying arrangement, and more particularly, to a copying apparatus equipped with an automatic document feeding device.

2. Brief Description of the Prior Art

Conventionally, in the copying apparatus of the above described type adapted to effect copying operation by automatically inverting or turning around a duplexed or both-sided original document, there has been proposed an arrangement provided with an original document inverting section by which the original document located at an original document feeding section for transporting the original document to be copied towards an image exposing and scanning section, is turned around or inverted to be returned to the original document feeding section again.

In the known copying apparatus as referred to above, for effecting an interrupting copying operation, it has been a practice to immediately discharge the original document subjected to the interruption, onto an original document discharge section. In the above practice, however, particularly with respect to the duplexed original documents, the discharged original documents are not aligned with respect to front or reverse faces thereof depending on whether the original documents subjected to interruption were being copied for the front faces or the reverse faces. Therefore, in order to feed the duplexed original documents again, it is necessary to effect the feeding after correctly ensuring that the original document immediately before the interrupting copying operation was being copied for its front face or reverse face. Thus, there were involved extremely troublesome procedures.

Similar problems as described above are also involved in the case where jamming of the original document takes place during copying operation with respect to the duplexed original document. More specifically, in the case where the original document subjected to the jamming is removed from the document feeding device for re-feeding of said original document, it is required to check whether the jamming took place during coping operation of the original document for its front face or reverse face. Thus, the operation for remedy of jamming becomes undesirably complicated.

SUMMARY OF THE INVENTION

Accordingly, an essential object of the present invention is to provide a copying apparatus equipped with an automatic duplexed original document feeding device, which is so arranged that, in the course of operation for an original document in an original document feeding path, after suspension of the operation, remaining operation with respect to said original document can be rapidly and correctly resumed.

Another object of the present invention is to provide a copying apparatus equipped with an automatic duplexed original document feeding device, which is so arranged that, in the course of operation of the original document at the original document feeding path, after executing an operation for interruptng the copying of an original document, with an interrupting signal for suspending said operation to effect an operation for another original document being inputted, the remaining operation for the copying of the original document before the interruption can be rapidly and correctly resumed.

A further object of the present invention is to provide a copying apparatus equipped with an automatic duplexed original document feeding device, which is so arranged that, upon suspension of the original document feeding function due to trouble during original document feeding taking place in the course of the operation for the original document at the original document feeding path, and after the remedy of that trouble, the remaining copying operation for the original document before the occurrence of the trouble can be rapidly and correctly resumed.

In accomplishing these and other objects, according to the one preferred embodiment of the present invention, there is provided a copying apparatus equipped with an automatic document feeding device which feeds original documents, one sheet by one sheet, from a first accommodating means for holding the original document to be copied so as to set a first face of said original document at an exposing position and, after the exposing operation for said first face, to set a second face thereof at the exposing position by inverting said original document, and after the exposing operation for the second face, to feed said original document from the exposing position to a second accommodating means for holding the original documents after the exposing operation, said copying apparatus comprises: means for outputting an instruction for suspending the original document feeding function of said original document feeding means;

a memory means for storing timing by which said suspending instruction was outputted, and a control means for controlling the feeding mode of a first original document after releasing said suspending instruction, according to the stored content of said memory means.

By the arrangement according to the present invention as described above, an improved copying apparatus equipped with an automatic original document feeding device has been advantageously presented, with substantial elimination of disadvantages inherent in the conventional copying apparatuses of this kind.

BRIEF DESCRIPTION OF THE DRAWINGS

These and other objects and features of the present invention will become apparent from the following description taken in conjunction with the preferred embodiment thereof with reference to the accompanying drawings, in which:

FIG. 4(*b*) is also an an electrical block diagram showing a control circuit for the automatic original document feeding device;

DETAILED DESCRIPTION OF THE INVENTION

Figure 1:
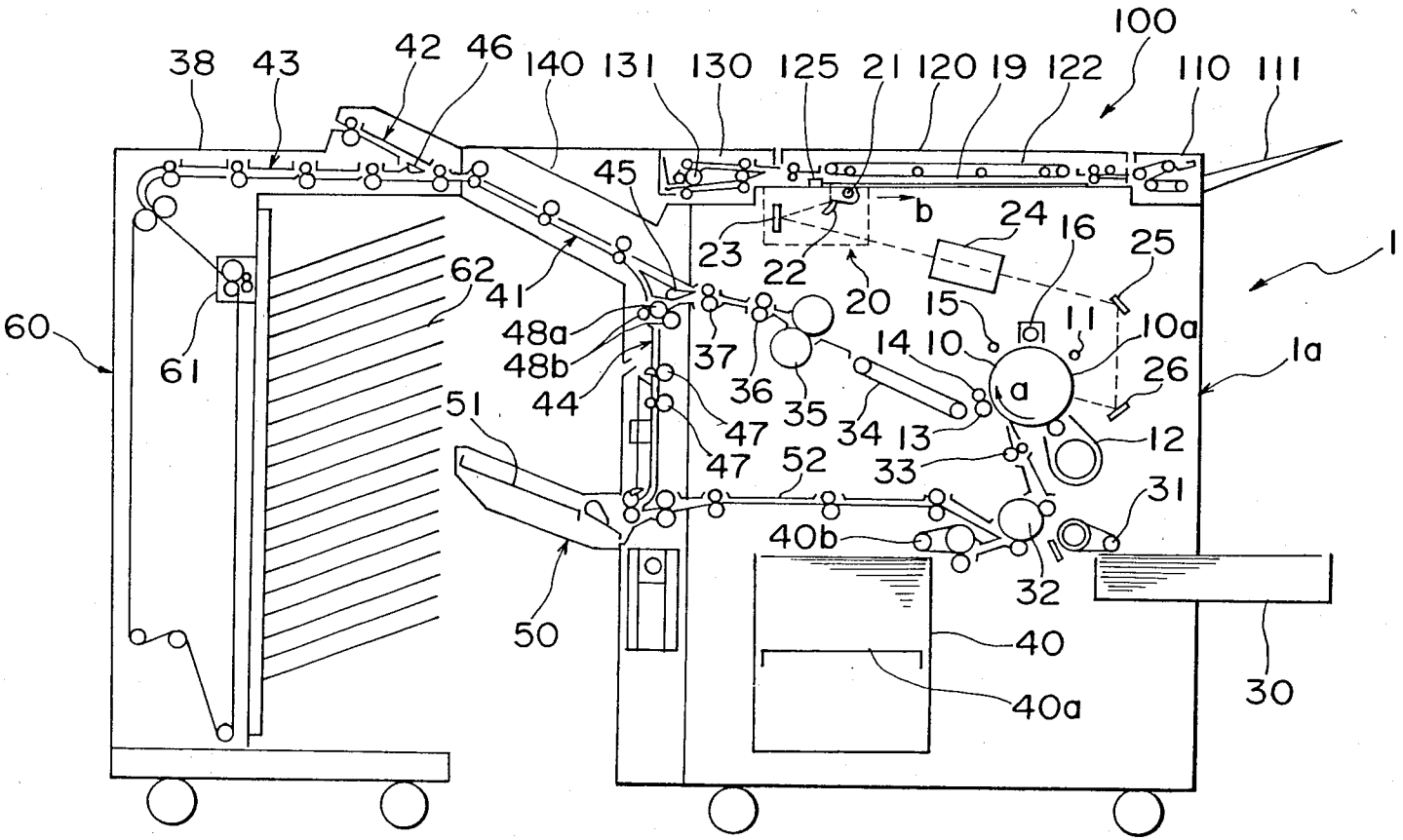
FIG. 1 is a schematic side elevational view of a copying apparatus equipped with an automatic original document feeding device according to one preferred embodiment of the present invention.

Before the description of the present invention proceeds, it is to be noted that like parts are designated by like reference numerals throughout the accompanying drawings.

Referring now to the drawings, the present invention will be described hereinbelow with respect to one preferred embodiment thereof.

General Construction of Copying Apparatus, FIG. 1

In FIG. 1, there is shown a copying apparatus 1 equipped with an automatic original document feeding device 100 according to the present invention.

The copying apparatus 1 generally includes a housing 1*a*, a photosensitive or photoreceptor drum 10 having a photoconductive layer 10*a* on its peripheral surface and rotatably provided at a central portion of the housing 1a for rotation in a direction indicated by an arrow (a), and various processing devices such as a corona charger 11 for uniformly charging the photoconductive surface 10*a* of the photoreceptor drum 10, a developing device 12 for causing toner to adhere onto the surface 10*a* of the photoreceptor drum 10 for developing, a transfer charger 13 for transferring the toner adhering to the surface of the photoreceptor drum 10, onto a copy paper sheet, a separating charger 14 for reducing any electrostatic attracting force between the copy paper sheet and the surface 10*a* of the photoreceptor drum 10, an eraser lamp 15 for erasing the electrical charge on the photoreceptor drum 10, and a cleaning device 16 for removing the toner remaining on the surface of the photoreceptor drum 10, etc., which are sequentially disposed around the photoreceptor drum 10 in a known manner for effecting the copying function.

The copying apparatus 1 also includes an optical system 20 having an exposure lamp 21, a first mirror 22 and a second mirror 23 which are arranged to scan in a direction indicated by an arrow (b), an image forming lens 24, a third mirror 25, and a fourth mirror 26. An original document (not particularly shown) placed on a transparent original document platform 19, for example, of a glass material is subjected to light projection from the exposure lamp 21, and light reflected therefrom is projected on the surface 10*a* of the photoreceptor drum 10 via the fourth mirror 26 through the first mirror 23, second mirror 23, image forming lens 24 and third mirror 25. In the above case, the exposure lamp 21 and the first mirror 22 are moved at a speed of V/m (m=copying magnification) with respect to a circumferential speed V of the photoreceptor drum 10 in the direction of the arrow (b), while the second mirror 23 is moved at a speed of V/2m also in the direction of the arrow (b).

Meanwhile, the copy paper sheets are accommodated in a paper feeding device 30 of a cassette type detachably mounted at one side of the apparatus housing 1*a* or in a paper feeding device 40 having a vertically movable platform 40*a* and provided at the lower portion of said housing 1a, and are fed, one sheet by one sheet, from the uppermost sheet of the stack through rotation of either one of a paper feeding roller 31 or 40*b* as selected by an operator.

More specifically, the photoconductive surface 10*a* of the photoreceptor drum 10 is imparted with a predetermined electrical charge by the corona charger 11 as the drum 10 is driven for rotation in the direction of the arrow (a), and is subjected to the image exposure by the optical system 20 so as to be formed thereon with an electrostatic latent image of the original document, which is developed by the developing device 12 into a visible toner image to be subsequently brought to the transfer station provided with the transfer charger 13. The copy paper sheet fed from either one of the paper feeding device 30 or 40 is directed upwardly by a U-turn roller 32, and is transported to the transfer station in synchronization with the toner image through a set of timing rollers 33. At the transfer station, the toner image is transferred by the transfer charge 13 onto the copy paper sheet thus fed, which is immediately separated from the surface 10*a* of the photoreceptor drum 10 by the charge erasing function of the separating charger 14 and the resiliency of the copy paper sheet itself so as to be subsequently fed into a fixing device 35 through a suction belt 34. In the fixing device 35, the copy paper sheet is subjected to fusing and fixing of the toner image thereonto, and is then discharged from a pair of discharge rollers 37 through a set of cooling rollers 36.

The copying apparatus 1 further includes a paper re-feeding section 50 for enabling forming duplexed copies and a sorter 60. The paper re-feeding section 50 referred to above is provided with a first feeding path 41 directed from the set of discharge rollers 37 towards the sorter 60, a fourth feeding path 44 directed to a paper re-feeding tray 51 to be mentioned later, and a change-over claw 45 pivotally provided at the branching portion between the first feeding path 41 and the fourth feeding path 44.

On the other hand, the sorter 60 has a second feeding path 42 leading to a discharge table 38, a third feeding path 43 directed towards a plurality of bins 62, and another change-over claw 46 provided at a branching portion between the second feeding path 42 and the third feeding path 43.

More specifically, in the case where the copy paper sheet is to be directly discharged onto the discharge table 38 in a one side copying operation, such copy paper sheet is fed via the first feeding path 41 and the second feeding path 42. Meanwhile, when it is required to align pages of the copy paper sheets to be discharged onto the discharge table 38, the copy paper sheet is transported to the first feeding path 41 via rollers 48*a*, 48*b* and rollers 47, with the front and reverse sides thereof reversed by subjecting the rollers 47 to reverse rotation, after one being fed into the fourth transport path 44, and is then discharged onto the discharge table 38. Otherwise, for the classification at the sorter 60, the copy paper sheets are fed from the first feeding path 41 to the third feeding path 43, and are successively accommodated into respective bins 62 through stepped downward movement of a deflecting portion 61.

On the other hand, in the case of executing a duplex copying operation, the copy paper sheet is transported from the fourth transport path 44 to the paper re-feeding tray 51 for inversion between the front and reverse faces, and from there, transported to the U-turn roller 32 through a paper re-feeding path 52 so as to be further fed to the transfer station via the timing rollers 32. Thereafter, the toner image is transferred onto the reverse face of the copy paper sheet, which is subsequently transported to the second feeding path 42 or the third feeding path 43 from the first feeding path 41 via the fixing device 35.

Figure 2:
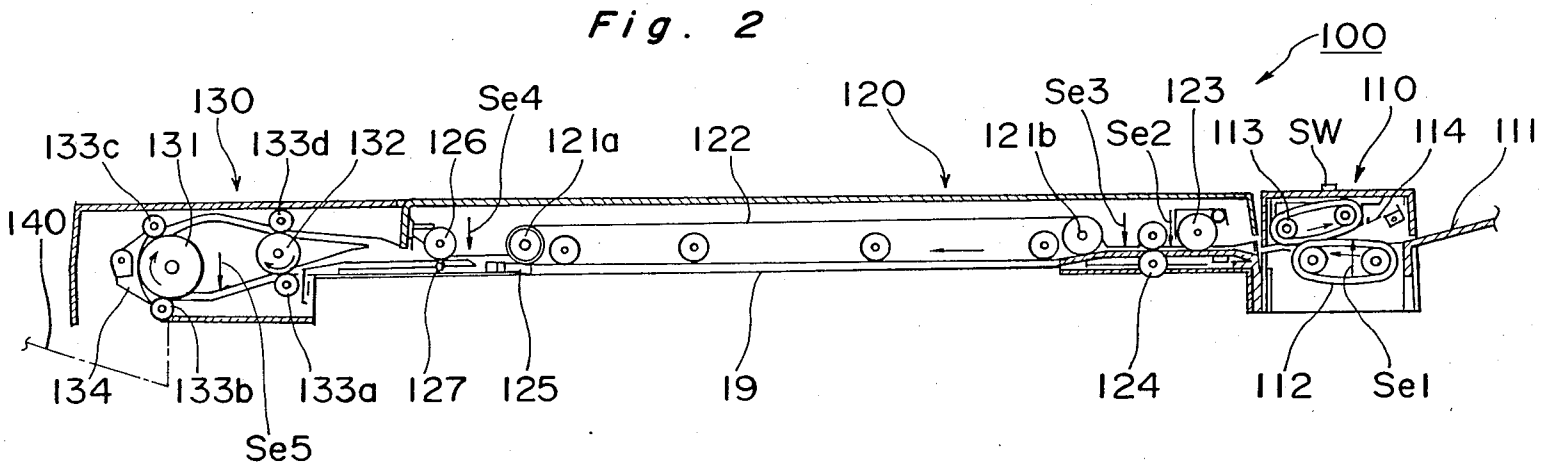
FIG. 2 is a side sectional view of the automatic original document feeding device employed in the copying apparatus of FIG. 1.

Automatic Original Document Feeding Device, FIG. 2

Subsequently, construction of the automatic original document feeding device 100 will be explained together with the functioning thereof.

The automatic original document feeding device 100 generally includes an original document feeding section 110, an original document transport section 120, an original document inverting section 130 and an original document discharge tray 140.

The original document feeding section 110 is so constructed that a paper feeding belt 112 and a separating belt 113 each movably supported by sets of spaced rollers are provided before an original document tray 111, while an original document presser plate 114 is pivotally provided for upward and downward movements immediately above the paper feeding belt 112. The original document (not particularly shown) is placed face down on the tray 111, with its leading edge being inserted between the belts 112 and 113, and is depressed by the presser plate 114. The original document feeding section 110 is brought into a stand-by state at the time point when a sensor Sel provided therein has detected the set original document, and the paper feeding belt 112 is driven in a counterclockwise direction by a paper feeding motor (not shown), thus feeding the separated original documents one sheet by one sheet, by moving the separating belt 113 in the same direction.

In the original document transport section 120, a transport belt 122 in the form of an endless belt is movably supported by a driving roller **121*a* and a driven roller 121*b* so as to be driven in a forward or reverse direction by a main motor (not shown) in a position above and adjacent to the original document platform 19. There are also provided a transport roller 123, a pair of pinch rollers 124, and original document detecting sensors Se2 and Se3 at the feeding side, while an original document stopper 125, a discharge roller 126 which can be driven for rotation in the forward or reverse direction, a guide roller 127 held in pressure contact with said roller 126 to follow in rotation, and an original document sensor Se4 are disposed at the discharge side. The stopper 125 is connected to a stopper solenoid (not shown), which projects into the original document feeding path when turned off, thereby to stop, at a predetermined position, the original document transported towards the left side in FIG. 2 on the original document platform 19 through the movement of the transport belt 122** in the forward or clockwise direction, while the stopper solenoid, when turned on, is retracted downwards to make it possible to discharge the original documents.

In the original document inverting section 130, driven guide rollers **133*a*, 133*b*, 133*c* and 133*d* are held in pressure contact with an inverting roller 131 driven for rotation in the clockwise direction by an inverting motor (not shown) and a transport roller 132, while an original document sensor Se5 is provided before the inverting roller 131. A return solenoid (not shown) is connected to an inverting guide plate 134, which is located in a position located in the counterclockwise direction from the solid line position in FIG. 2 when said solenoid is turned off so as to close the inverting path for leading the original document onto the discharge tray 140. Meanwhile, upon turning on of the return solenoid, the inverting guide plate 134 is rotated to the solid line position, thereby to invert the original document discharged from the transport section 120 along the inverting roller 131. The original document thus inverted is again returned onto the platform 19 through reverse rotation of the discharge roller 126 and movement of the transport belt 122** in the reverse direction.

On the upper surface of the original document feeding section 110, there is provided a start switch SW for starting the functioning of the automatic original document feeding device 100. This start switch SW is of a self-illuminating type switch incorporating red and green lamps, and is arranged to light the green lamp in a state where the feeding device 100 is capable of accepting the operation through the start switch SW, and to light the red lamp when the feeding device 100 can not accept the operation therethrough.

The procedures for controlling the original document feeding device 100 will be described in more detail later with reference to flow-charts.

Figure 3:
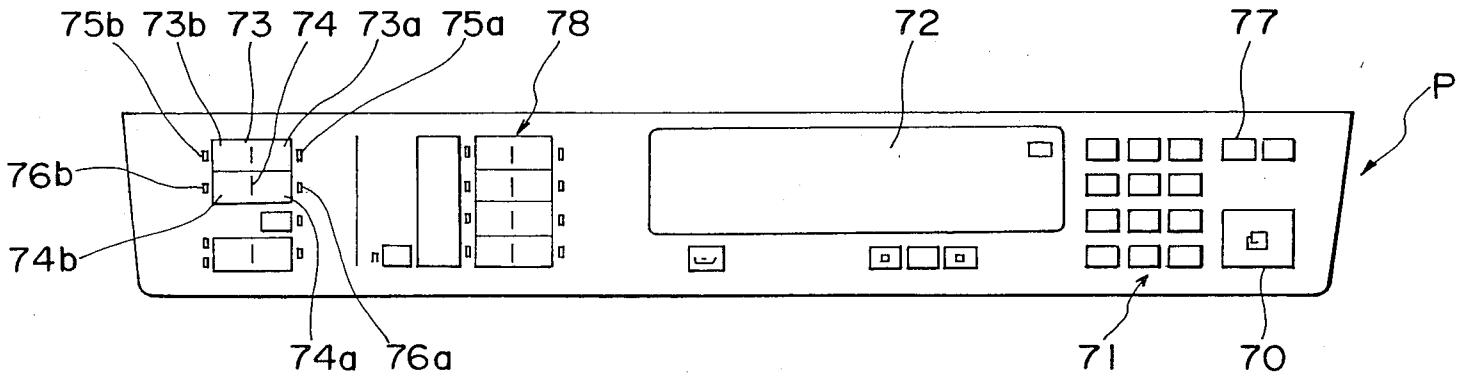
FIG. 3 is a top plan view of a control panel for the copying apparatus of FIG. 1.

Control Panel, FIG. 3

In FIG. 3, there is shown a control panel P provided on the upper portion of the housing **1*a* of the copying apparatus 1, and including a print switch 70, a group of keys 71 for setting the number of copies to be taken, a display portion 72, for example, by liquid crystal, and copying mode selecting switches 73 and 74. The print switch 70 referred to above is of a self-illuminating type incorporated with red and green lamps, and adapted to light the green lamp when the copying apparatus is ready to accept the operation through the print switch 70, and to light the red lamp in the state where the copying apparatus can not accept the operation by said switch 70. Meanwhile, the copying mode selecting switches 73 and 74** are arranged to select how to copy a one sided or duplexed original document (i.e., for one side copying or both side copying), and are composed of see-saw type switches.

For the copying modes, four kinds of modes are available, i.e., (I) one sided original document to one side copying, (II) one sided original document to both side copying, (III) duplexed original document to one side copying, and (IV) duplexed original document to both side copying. Mode (I) may be selected by depressing an upper right portion **73*a* of the switch 73, while mode (II) can be selected by depressing an upper left portion 73*b* thereof, respectively. Mode (III) may be selected through depression of an upper right portion 74*a* of the switch 74, while mode (IV) may also be selected by depressing an upper left portion 74*b* of said switch 74. The above selection is indicated by the lighting of display light emitting diodes 75*a*, 75*b*, 76*a* and 76*b* provided at the side portions of the upper portions of the respective switches. There are also provided an interrupting key 77 for effecting the interrupting copying by suspending the copying operation currently executed at a predetermined timing, and a group of keys 78** for selection of copying magnifications.

Figure 4A:
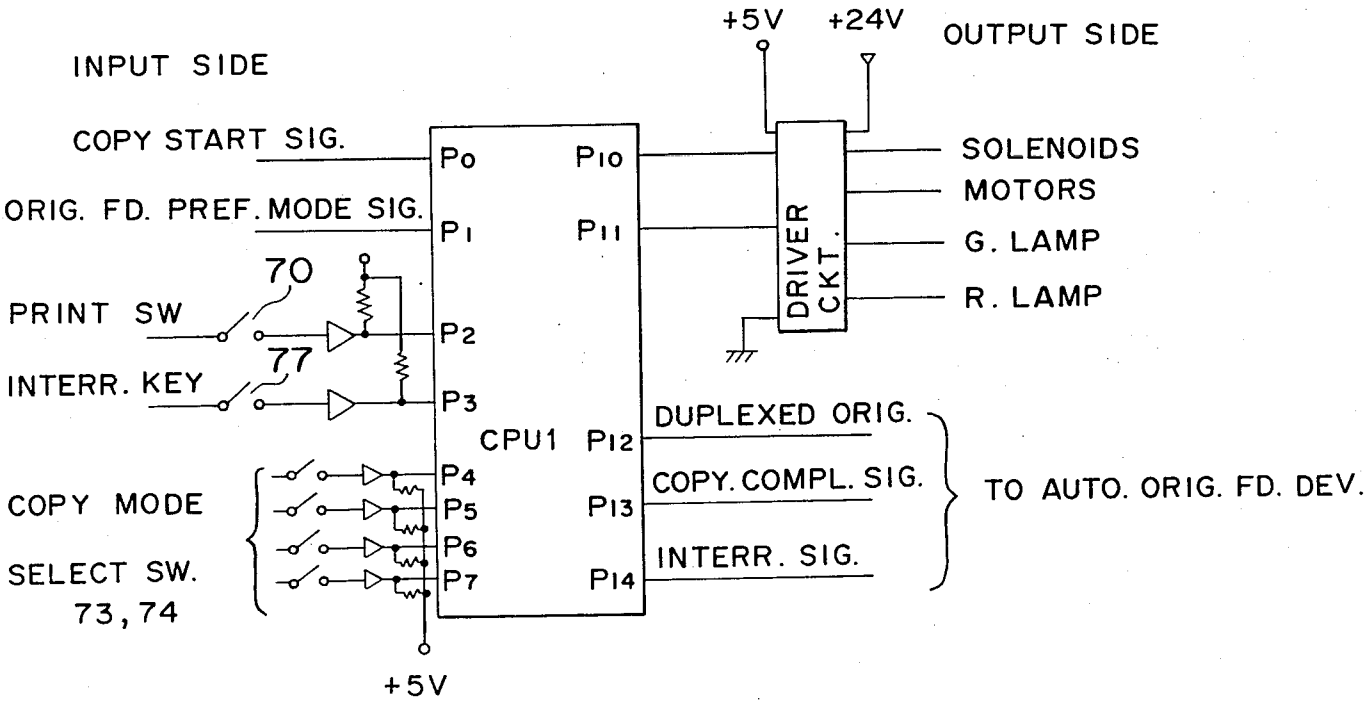
FIG. 4(*a*) is an electrical block diagram showing a control circuit for the copying apparatus main body.
Figure 4B:
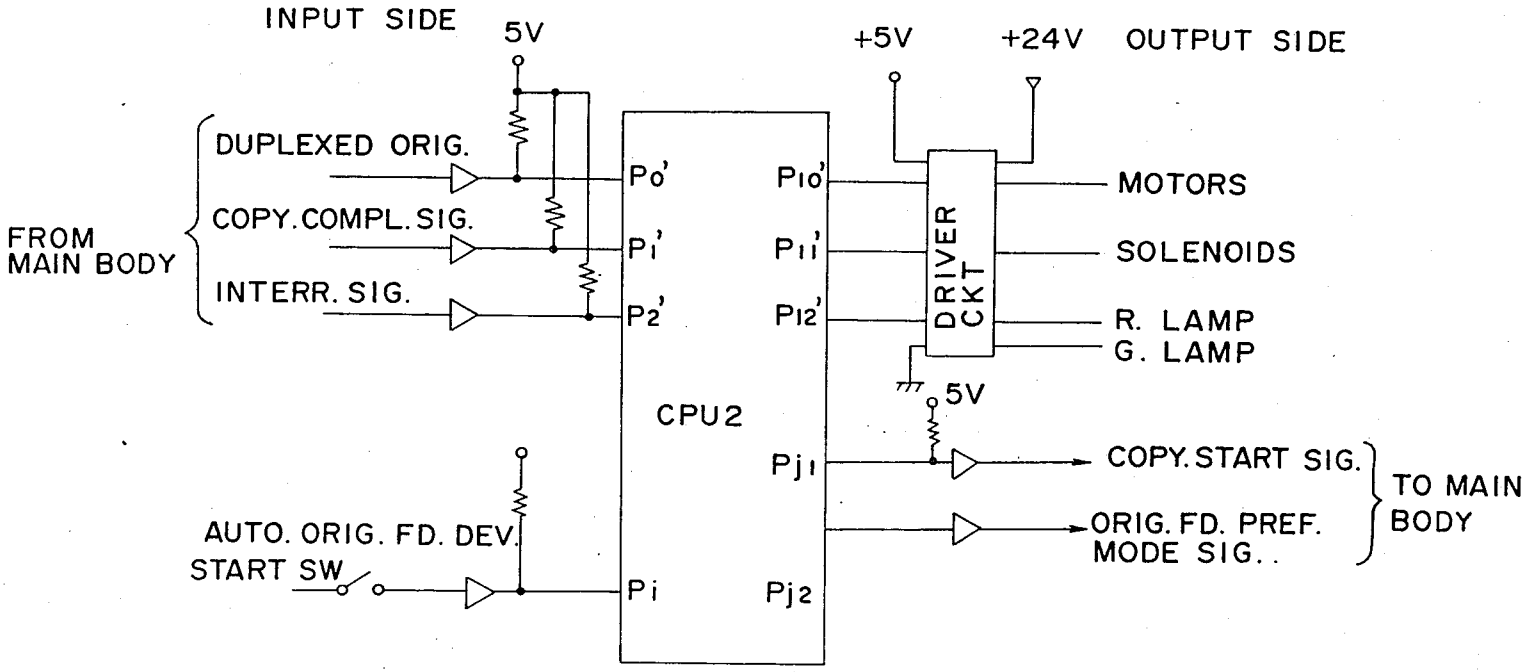

Control Circuit, FIGS. 4(*a*) and 4(*b*)

Referring to FIG. 4(*a*), there is shown a control circuit for the copying apparatus main body 1, in which a micro-computer CPU 1 includes input ports P0, P1, P2, P3, P4, P5, P6 and P7, and output ports P10, P11, P12, P13 and P14. To the input port P0, a copy starting signal is applied, while to the input port P1, original document feeding preferential mode signals (to be described later) are inputted respectively from micro-computer CPU 2 for a control circuit of the automatic original document feeding device 100. To the input port P2, on/off signals of the print switch 70 are applied, while on/off signals of the interrupting key 77 are inputted to the input port P3. Meanwhile, on/off signals of the copying mode selecting switches 73 and 74 are applied to the input ports P4 through P7. On the other hand, the output ports P10 and P11 are connected to a driver circuit for turning on or off motor, solenoids, etc. within the copying apparatus 1, and also for selective illumination and/or flickering of the green and red print lamps incorporated in the print switch 70.

In FIG. 4(*b*) showing the control circuit for the automatic original document feeding device 100, the microcomputer CPU 2 is provided with input ports P0', P1', P2' and Pi and output ports P10', P11', P12' and Pj1 and Pj2 as shown. To the input port P0', a signal representing whether or not the original document is of the duplexed original document is applied, and to the input port P1', a copying completion signal is inputted, while to the input port P2', an interrupting signal is applied respectively from the micro-computer CPU 1. Meanwhile, to the input port Pi, on/off signals of the start switch SW for the automatic original document transport device 100 are inputted, and moreover, on/off signals of the original document detecting sensors Se1 to Se5 are also applied thereto (not shown). On the other hand, the output ports P10' to P12' are connected to a driver circuit for turning on or off the main motor for driving the transport belt 122 and the discharge roller 126, the paper feeding motor for driving the paper feeding belt 112 and the separating belt 133, the inverting motor for driving the inverting roller 131 and transport roller 132, and also the stopper solenoid for driving the original document stopper 125 and the return solenoid for driving the inverting guide plate 134, and further, causing the green and red start lamps incorporated in the start switch SW to light or flicker selectively. The output port Pj1 applies the copy start signal to the micro-computer CPU 1 of the copying apparatus 1, while the output port Pj2 applies the original document feeding preferential mode signal thereto.

Figure 5A:
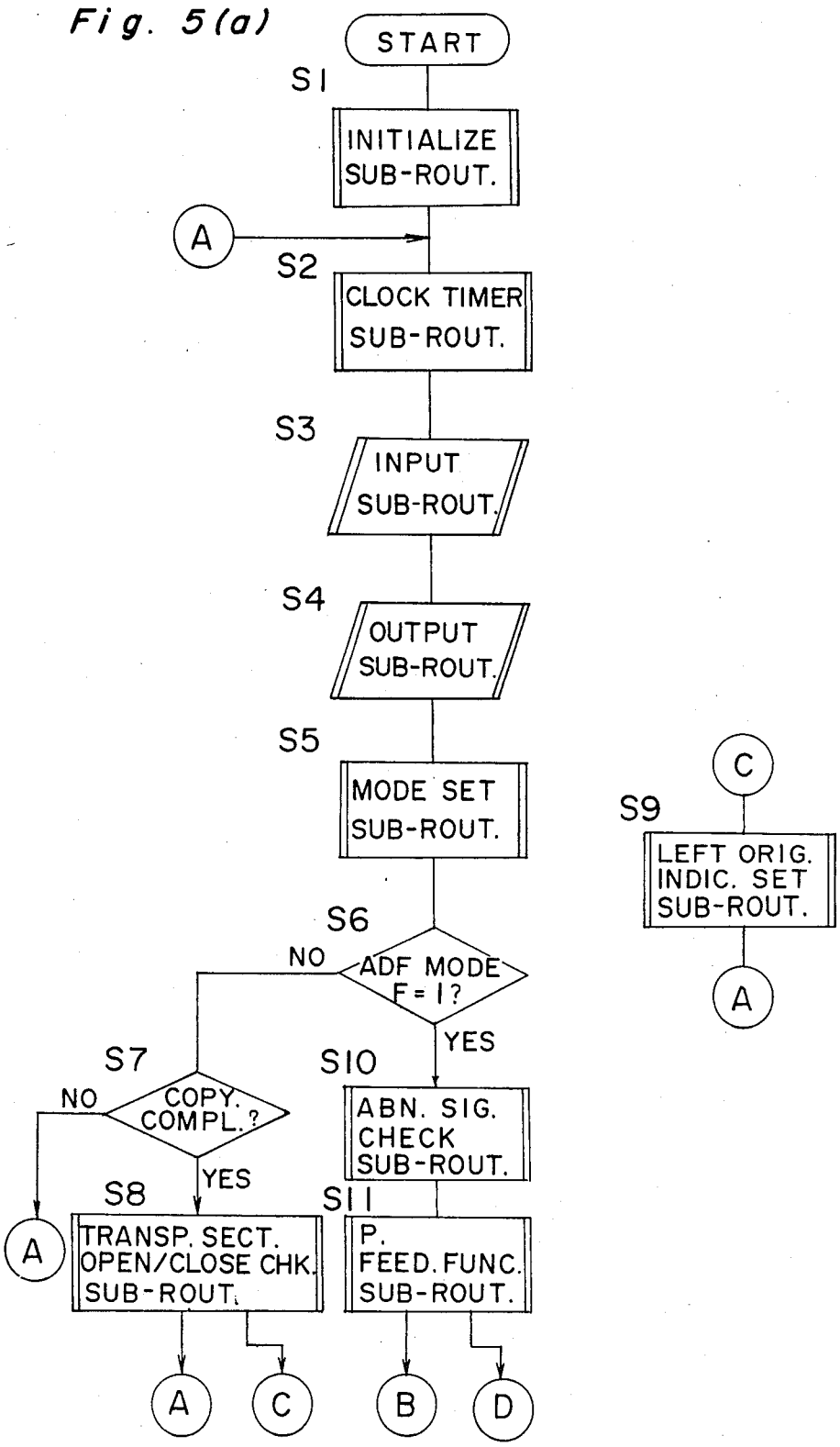
FIGS. 5(*a*) and 5(*b*) are a continuous flow-chart showing a main routine of the control procedures for the automatic original document feeding device according to the present invention.
Figure 9:
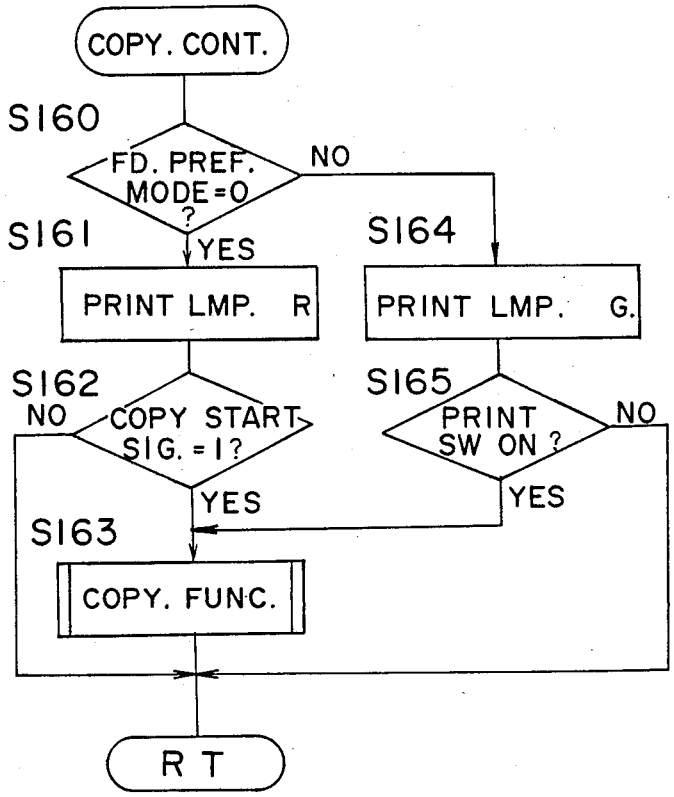
FIG. 9 is a flow-chart showing a sub-routine for the copying control.

Control Procedures, FIG. 5(*a*) through FIG. 9

In a continuous flow-chart of FIGS. 5(*a*) and 5(*b*), there is shown a main routine of the control procedure for the automatic original document feeding device 100.

More specifically, in an initialize sub-routine at step S1, the initial setting of the micro-computer CPU 2 is effected, and subsequently, in a clock timer sub-routine at step 2, a basic timer is operated in synchronization with pulse signals of the main motor, while an internal timer is actuated during the off period of the main mode. Thereafter, in input and output sub-routines at steps S3 and S4, the input and output of the micro-computer CPU 2 are executed, and based on the state of the above input and output, a functioning mode for the automatic original document feeding device 100 is determined in a mode set sub-routine at step S5. In the above mode set sub-routine at step S5, for example, when the original document to be copied is set and the start switch SW is turned on, ADF mode flag is set to "1" to execute the paper feeding function sub-routine to be described later.

At step S6, judgement is made as to whether or not the ADF mode flag is "1", and if the judgement is "NO", i.e., when the state is in the copying function in which feeding of the original document is not effected in the feeding device 100, completion of the copying is waited for at step S7, and continuously in a transport section open/close check sub-routine at step S8, the original document transport section 120 is checked to watch out for any original docuemnt carelessly left. If thee is such a left original document, this is indicated in a left original document indication set sub-routine at step S9. Meanwhile, if the judgement is "YES" at step S6, i.e., when the copying is effected through employment of the feeding device 100, the operation for the case where the interrupting key 77 is depressed, is executed in an abnormal signal check sub-routine at step S10.

In a paper feeding function sub-routine at step S11, the function control from the turning-on of the original document feeding switch to the arrival of the leading edge of the original document at the pinch rollers 124 is executed.

Meanwhile, in a feeding function sub-routine at step S12, the original document standing by at the pair of pinch rollers 124 is transported until the leading edge thereof contacts the stopper 125 to be stopped thereat, and the processing for applying the copying start signal to the copying apparatus is effected.

In an inverting function sub-routine at step S13, in the case where the copying by the duplexed original document has been selected, there are effected such processings that the original document is returned to the transport section 120 through the original document inverting section 130 so as to be again stopped by the stopper 125 and the copying start signal is applied to the copying apparatus.

In a discharge function sub-routine at step S14, there is executed the processing for discharging the duplexed original document once inverted or the one sided original document onto the discharge tray 140 as it is.

In an inverting feeding function sub-routine at step S14, the processings to be effected are such that the original document again fed by the re-feeding function immediately after the restoration from the original document jamming or after the interrupting copying is directly fed into the inverting section 130 from the pair of pinch rollers 124 via the transport section 120 for inversion so as to be stopped at the stopper 125, with the copying start signal being applied to the copying apparatus.

On the other hand, in the case where jamming of the original document takes place in the inverting function sub-routine at step S13 or inverting feeding function sub-routine at step S15, judgement is made at step S17 as to whether or not the front surface of the original document has been copied, and if the judgement is "YES", the inverting feeding request flag for executing the inverting feeding function sub-routine at step S15 is set to "1". Thus, in a jamming indication set sub-routine at step S19, the processing for effecting the indication for the jamming is excuted. Subsequently, when the jamming is removed, with the predeteremined jam restoring operation being effected, the procedure is reverted to step S2, and more specifically, a jam reset switch (not shown) is operated.

Subsequently, the inverting function sub-routine at step S13 will be described in detail with reference to FIGS. 6(*a*) through 6(*g*).

The above sub-routine is effected after completion of copying for the front surface of the duplexed original document when the functioning mode for a duplexed original document is selected by the operator.

Thus, when the interrupting signal is inputted during copying of the reverse surface of the duplexed original document, the duplexed original document is inverted to be discharged onto the discharge tray 140, while the the case where the interrupting signal is released and the discharged original document is again fed, such a control is effected that said original document is immediately passed through the transport section 120 so as to be inverted at the inverting section 130 for being returned to the transport section 120 again.

Meanwhile, in the case where jamming takes place at the inverting section 130, and also, in the case where the original document removed from the inverting section 130 is fed again, it is so controlled that said original document is immediately fed to the inverting section 130 via the transport section 120, and after being inverted at said inverting section 130, is again fed into the transport section 120 so as to be stopped at the image exposure scanning position. As a result, the operator is only required to set the original document face down on the original document tray 111 at all times.

In the first place, at step S20, it is judged whether or not an inverting flag is "1". This inverting flag is set to "1" by the copying completion signal for the front face of the original document, and maintains the set state until the termination of this sub-routine (so as to be reset at step S100). If the inverting flag has been set, it is judged, at step S21, whether or not an original document stopper solenoid (referred to as OSTSL hereinafter) request flag is "1". This OSTSL request flag is to indicate the on/off state of the original document stopper solenoid. If it is in the off state, i.e., when the original document stopper 125 has entered the original document feeding path, the OSTSL request flag hs been reset to "0", and the judgement is "NO" at this step S21, and it is checked at step S22, whether or not an OSTSL function completion flag is "1". In this case, the judgement is "NO" at step S22 because the OSTSL function completion flag is still in the reset state to "0", and the OSTSL request flag is set to "1" at step S23 as well as a timer TMR1 is set to $\alpha_1$H at step S24. This timer TMR1 is intended to provide timing for starting the original document discharge function.

Simultaneously, at step S25, the stopper solenoid is turned on so as to be retreated from the original document feeding path, and at step S26, the OSTSL function completion flag is set to "1".

On the other hand, if the judgement is "YES" at step S21, termination of functioning of the timer TMR1 is waited for at step S28, and upon termination thereof, a TMRJ1 request flag is set to "1" at step S29, while a timer TMRJ1 is set to $\alpha_2$H at step S30. This timer TMRJ1 is intended to check whether or not any jamming has taken place before the original document reaches the transport section DE discharge sensor Se4. Simultaneously, at step S31, the main motor is turned on for rotation in the forward direction so as to move the transport belt 122 in the clockwise direction, while at step 32, the inverting motor is turned on for driving the rollers 131 and 132 in the clockwise direction, and also, at step S33, the return solenoid is turned on for changing over the inverting guide plate 134 so that the original document is led to the inverting section 130, and at step S34, the OSTSL request flag is set to "0". By the above procedure, the original document positioned on the original document platform 19 begins to be discharged from the transport section 120.

Subsequently, at step S35, judgement is made as to whether or not the TMRJ1 request flag is "1". The judgement is "YES" since the TMRJ1 request flag has been reset to "1" at step S29, and at step S36, it is judged whether or not the transport section DF discharge sensor Se4 has fallen, i.e., whether or not the sensor Se4 has detected the leading edge of the original document. If the judgement is "NO", it is judged, at step S37, whether or not the timer TMRJ1 is terminated, and if it is terminated, paper jamming has taken place before arrival at the sensor Se4, and the procedure proceeds to said steps S17, S18 and S19 so as to set the inverting feeding request flag to "1", and also to effect the indication for the jamming. If the leading edge of the original document is detected by the sensor Se4 before the timer TMRJ1 is terminated (i.e., judgement is "YES" at step S36), the TMRJ1 request flag is reset to "0" at step S38, while at step S39, the timer TMRJ1 is reest. At the same time, at step S40, a timer TMRJ2 is set to $\alpha_3$H, and at step S41, a TMRJ2 request flag is set to "1". This timer TMRJ2 is intended to check whether or not the paper jamming has taken place before arrival of the original document from the inverting section R to the discharge sensor Se5.

Subsequently, at step S42, judgement is made as to whether or not the TMRJ2 request flag is "1". The judgement is "YES" since this TMRJ2 request flag has been set to "1" at step S41, and at step S43, it is judged whether or not the inverting section R discharge sensor Se5 has fallen, i.e., whether or not the sensor Se5 has detected the leading edge of the original document. If the judgement is "NO", it is checked, at step S44, whether or not the timer TMRJ2 is terminated. If said timer is terminated, it means that paper jamming has taken place before arrival at the sensor Se5, and therefore, the procedure proceeds to steps S17, S18 and S19 so as to set the inverting transport request flag to "1", and also to effect indication for the jamming.

When the leading edge of the original document is detected by the sensor Se5 before termination of the timer TMRJ2 (i.e., judgement is "Yes" at step S43) the stopper solenoid is turned off at step S45, and the timer TMRJ2 is reset at step S46, while at step S47, the TMRJ2 request flag is reset to "0". Simultaneously, at step S48, a timer TMR2 is set to $\alpha_4$H, and at step S49, a TMR2 request flag is set to "1". This timer TMR2 is intended to set the timing for stopping the original document discharge function. Furthermore, at step S50, a timer TMRJ3 is set to $\alpha_5$H, while a TMRJ3 request flag is set to "1" at step S51. This timer TRMJ3 is intended to check whether or not any paper jamming has taken place before the original document reaches the sensor Se4 from the sensor Se5 through the inverting section 130.

Subsequently, at step S42, it is judged whether or not the TMR2 request flag is "1". The judgement is "YES"

since this TMR2 request flag has been set to "1" at step S49. A step S53, termination of the timer TMR2 is waited for, and upon termination, the main motor is turned off at step S54 to stop movement of the transport belt 122 in the forward direction, with the return solenoid being turned off at step S55. Simultaneously, a reverse rotation starting request flag is set to "1" at step S56, while at step S57, a timer TMR3 is set to $\alpha_6$H. The timer TMR3 is intended to provide timing for the reverse rotation of the main motor. Moreover, at step S58, TMR2 request flag is set to "0", with the timer TMR2 being reset at step S59.

Subsequently, at step S60, it is checked whether or not the reverse rotation starting request flag is "1". Since the reverse rotation starting flag has been set to "1" at step S56, the judgement is "YES". At step S61, termination of the timer TMR3 is waited for, and upon termination, the main motor is turned on at step S62 for reverse rotation so as to drive the transport belt 122 in the counterclockwise direction. At the same time, TMR3 request signal is reset to "0" at step S63, with the timer TMR3 being reset at step S64.

Thereafter, at step S65, it is judged whether or not TMRJ3 request flag is "1". Since this TMRJ3 request flag has been set to "1" at step S51, the judgement is "YES", and at step S66, it is judged whether or not the transport section DF discharge sensor Se4 has fallen, i.e., whether or not the sensor Se4 has detected the leading edge of the inverted original document. If the judgement is "NO", judgement is made at step S67 as to whether or not the timer TMRJ3 is terminated. If said timer is completed, it means that jamming has taken place before arrival at the sensor Se4, and therefore, the procedure is shifted to steps S17, S18 and S19 referred to earlier so as to set the inverting feeding request flag to "1", with simultaneous indication for the jamming.

If the leading edge of the original document is detected by the sensor Se4 before termination of the timer TMRJ3 (i.e., judgement is "YES" at step S66), the TMRJ3 request flag is reset to "0" at step S68, while the timer TMRJ3 is reset at step S69. Simultaneously, a TMRJ4 request flage is set to "1" at step S70, and at step S71, a timer TMRJ4 is set to $\alpha_7$H. This timer TMRJ4 is intended to judge whether or not any paper jamming has taken place during passing of the inverted original document through the discharge sensor Se4.

Then, at step S72, it is checked whether or not the TMRJ4 request flag is "1". The judgement is "YES", since this TMRJ4 request flag has been set to "1" at step S70 referred to earlier, and at step S73, judgement is made as to whether or not the discharge sensor Se4 has risen, i.e., whether or not said sensor has detected the trailing edge of the inverted original document. If the judgement is "NO", it is checked at step S74 whether or not the timer TMRJ4 is terminated. If said timer is terminated, it means that paper jamming has taken place before arrival of the trailing edge of the original document at the discharge sensor Se4, and therefore, the procedure is shifted to steps S17, S18 and S19 described earlier so as to set the inverting feeding request flag to "1", with simultaneous indication for the jamming.

If the trailing edge of the original document is detected by the sensor Se4 before termination of the timer TMRJ4 (i.e., judgement is "YES" at step S73), the TMRJ4 request flag is reset to "0" at step S75, while at step S76, the timer TMRJ4 is reset. At the same time, at step S77, a reverse rotation stop request flag is set to "1", and at step S78, a timer TMR4 is set to $\alpha_8$H. This timer TMR4 has for its object to provide timing for turning off the main motor. At step S79, the inverting motor is turned off to stop rotation of the rollers 131 and 132.

Subsequently, at step S80, it is judged whether or not reverse rotation stop request flag is "1". The judgement is "YES" since this reverse rotation stop request flag has been set to "1" at step S77. Thus at step S81, termination of the timer TMR4 is waited for, and upon termination, the main motor is turned off in its reverse rotation so as to stop the transport belt 122 moving in the reverse direction. In this case, the original document is stopped at a position where its trailing edge has advanced to a certain extent beyond the stopper 125 towards the right in FIG. 2 on the original document platform 19. Simultaneously, at step S84, a timer TMR5 is set to $\alpha_9$H, and a step S85, a TMR5 request flag is set to "1". This timer TMR5 is intended to provide timing for rotating the main motor again in the forward direction. Furthermore, at step S86, copying request signal is reset, and the timer TMR4 is reset at step S87, while at step S88, TMR4 request flag is reset to "0".

Thereafter, at step S89, it is judged whether or not TMR5 request flag is "1". The judgement is "YES", since this TMR5 request flag has been set to "1" at step S85 as described earlier. Thus, at step S90, termination of the timer TMR5 is waited for, and upon termination, the timer TMR5 is reset at step S91, while at step S92, the TMR5 request flag is reset to "0". Simultaneously, at step S93, the main motor is turned on for rotation in the forward direction to drive the transport belt 122 in the clockwise direction for feeding the inverted original document returned onto the original document platform 19 in the leftward direction in FIG. 2. Subsequently, at step S94, a TMR6 request flag is set to "1", while at step S95, a timer TMR6 is set to $\alpha_{10}$H. This timer TMR6 is intended to turn off the main motor in it rotation in the forward direction.

Then, at step S96, it is judged whether or not TMR6 request flag is "1". Since this TMR6 request flag has been set to "1" at step S94, the judgement is "YES". Thus, at step S97, termination of the timer TMR6 is waited for, and upon termination, the timer TMR6 is reset at step S99. In this case, the trailling edge of the original document contacts the original document stopper 125 so as to be stopped at a predetermined position on the original document platform 19. At the same time, at step S100, the inverting flag is reset to "0", and at step 101, the copying start signal for starting the copying function is outputted. At step S102, the main motor is turned off in the forward rotation so as to suspend the movement of the transport belt 122 in the forward direction, while at step S103, OSTSL function completion flag is reset to "0". Successively, at step S104, it is judged whether or not inverting function II flag is "1", and if the judgement is "YES", i.e., when the inverting function is not required, the inverting feeding request flag is reset to "0" at step S105.

By the foregoing procedures, the inverting function of the original document is completed, and thereafter, the copying function with respect to the reverse face of the duplexed original document by the optical system 20 is effected.

Figure 5B:
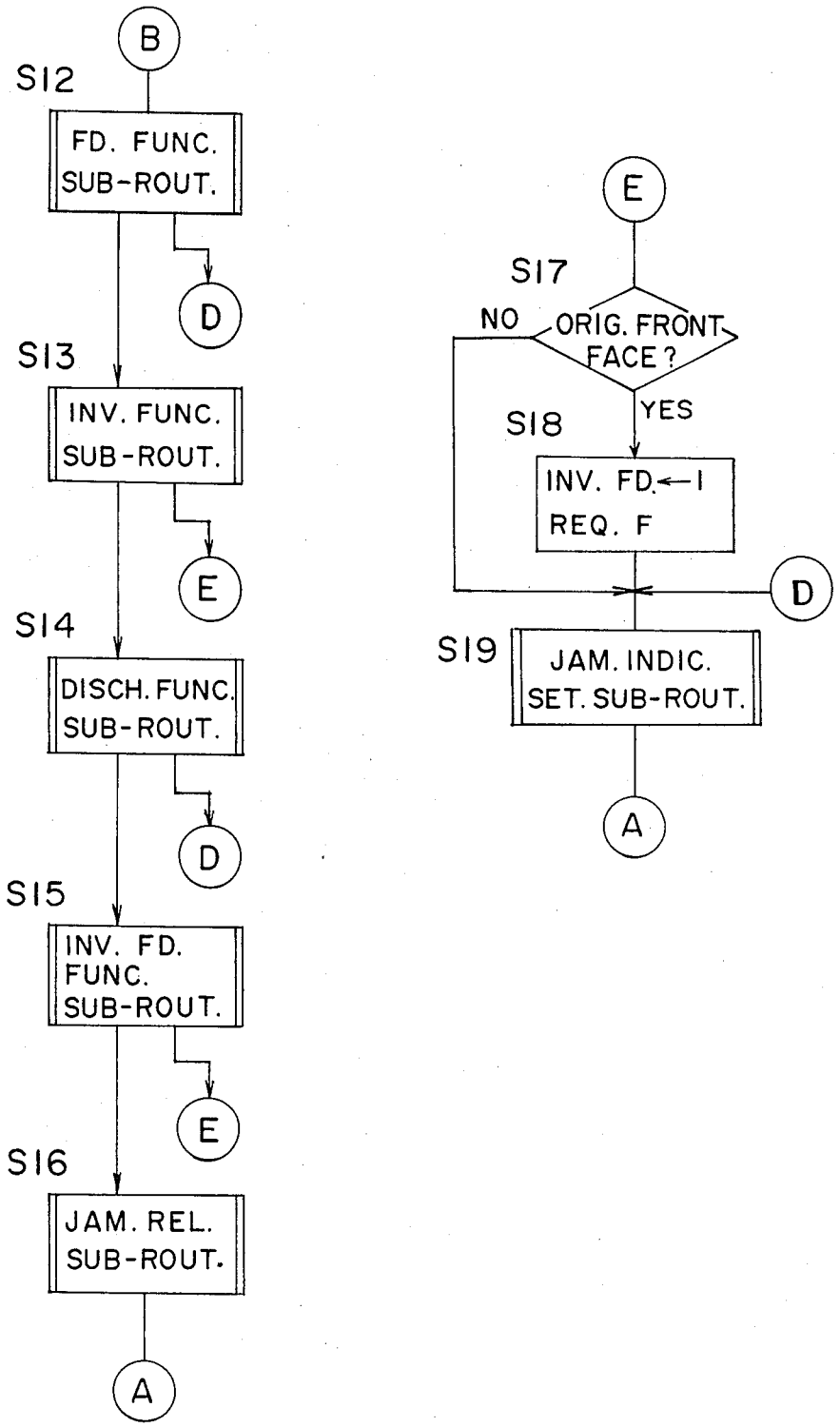
Figure 6A:
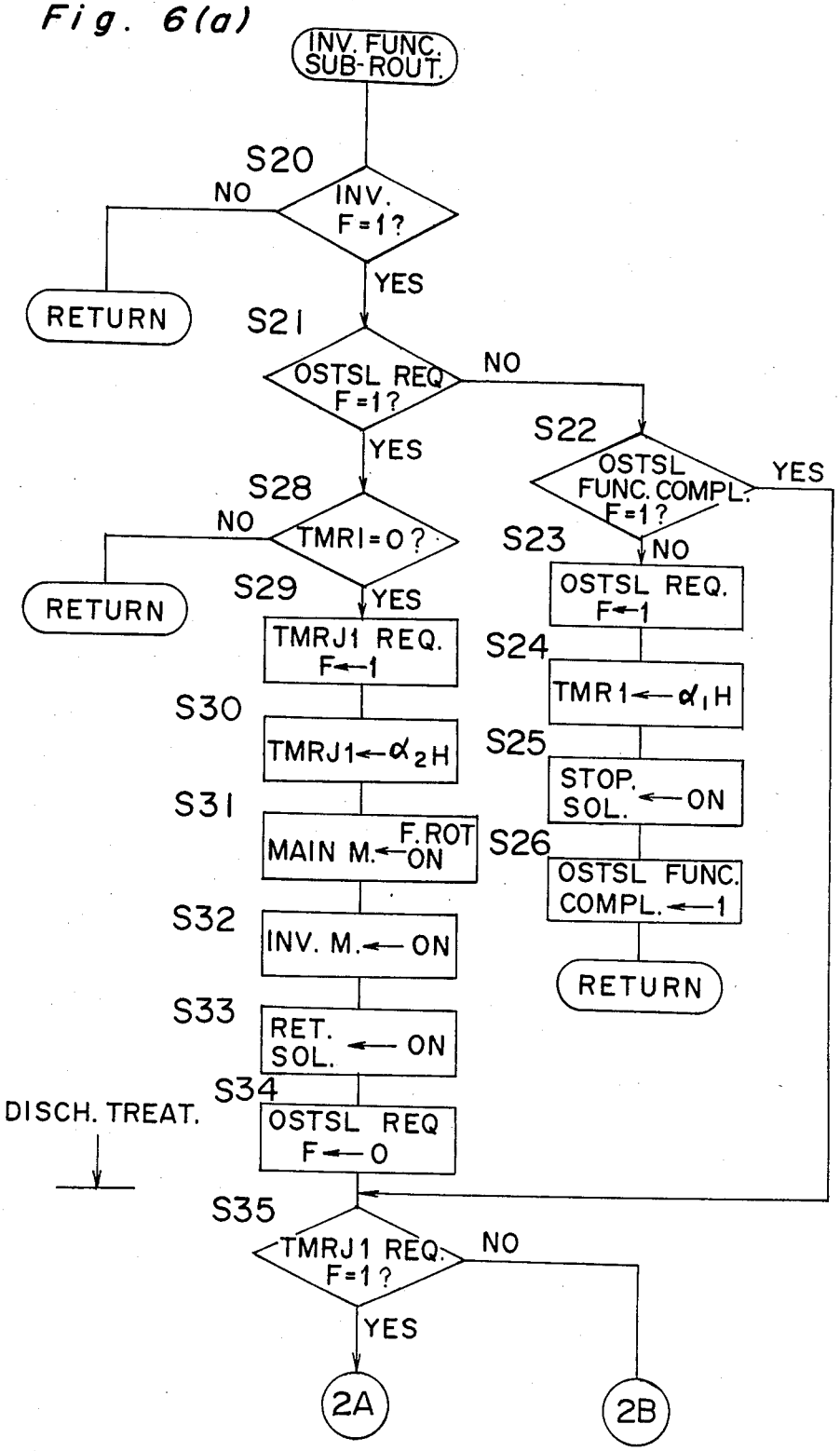
FIGS. 6(*a*) through 6(*g*) are flow-charts showing inverting function sub-routines at a step S13 in FIG. 5(*b*)
Figure 6B:
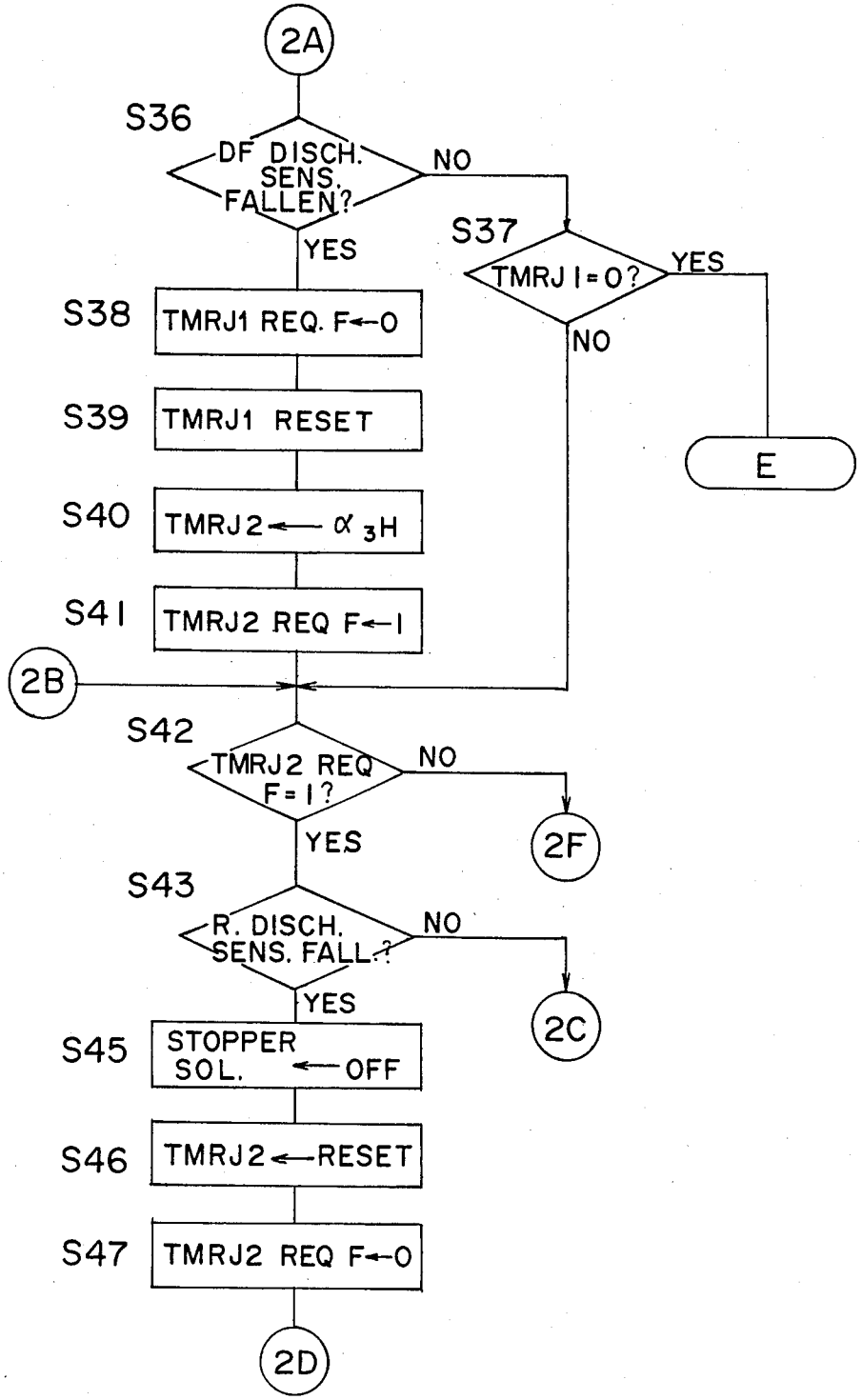
Figure 6C:
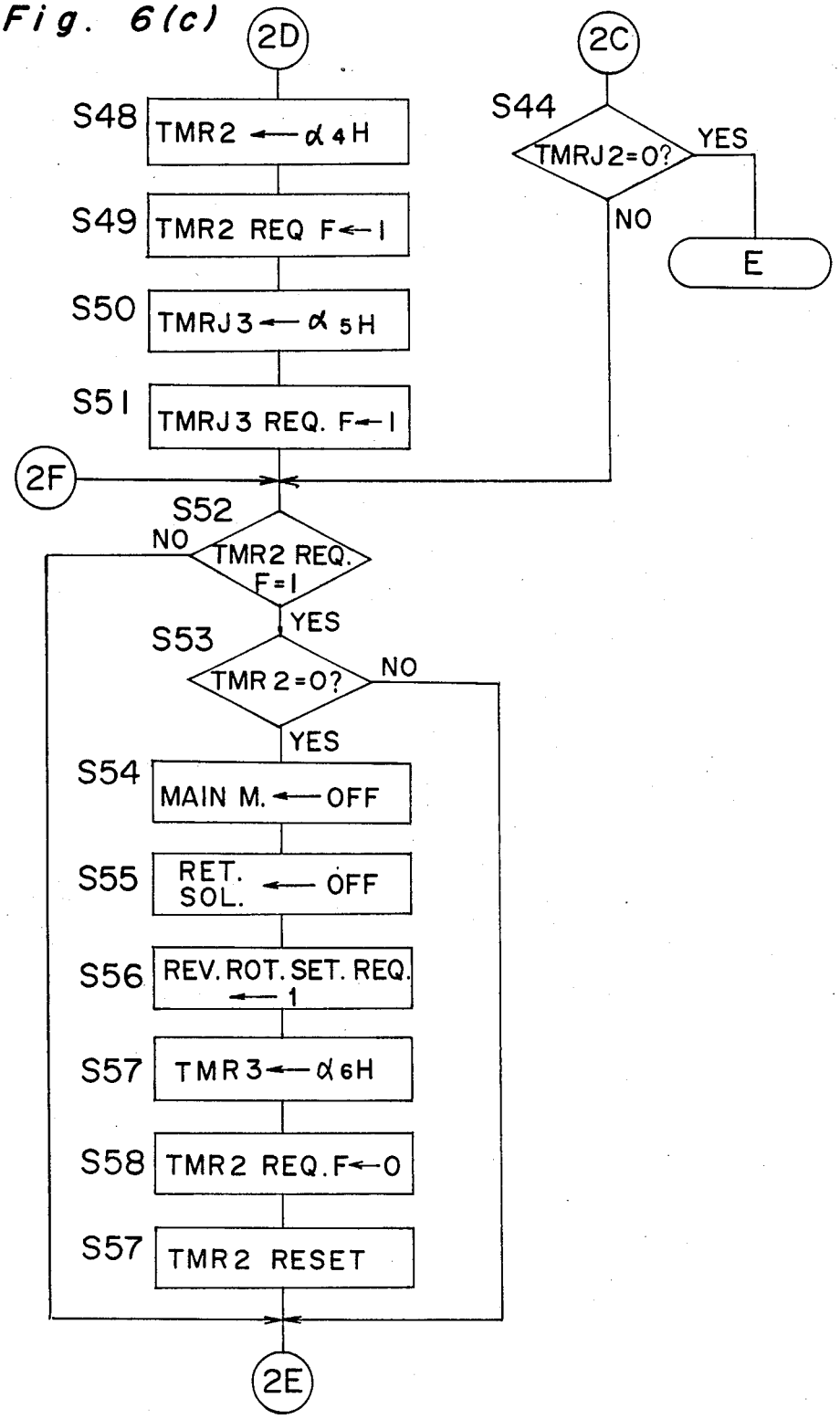
Figure 6D:
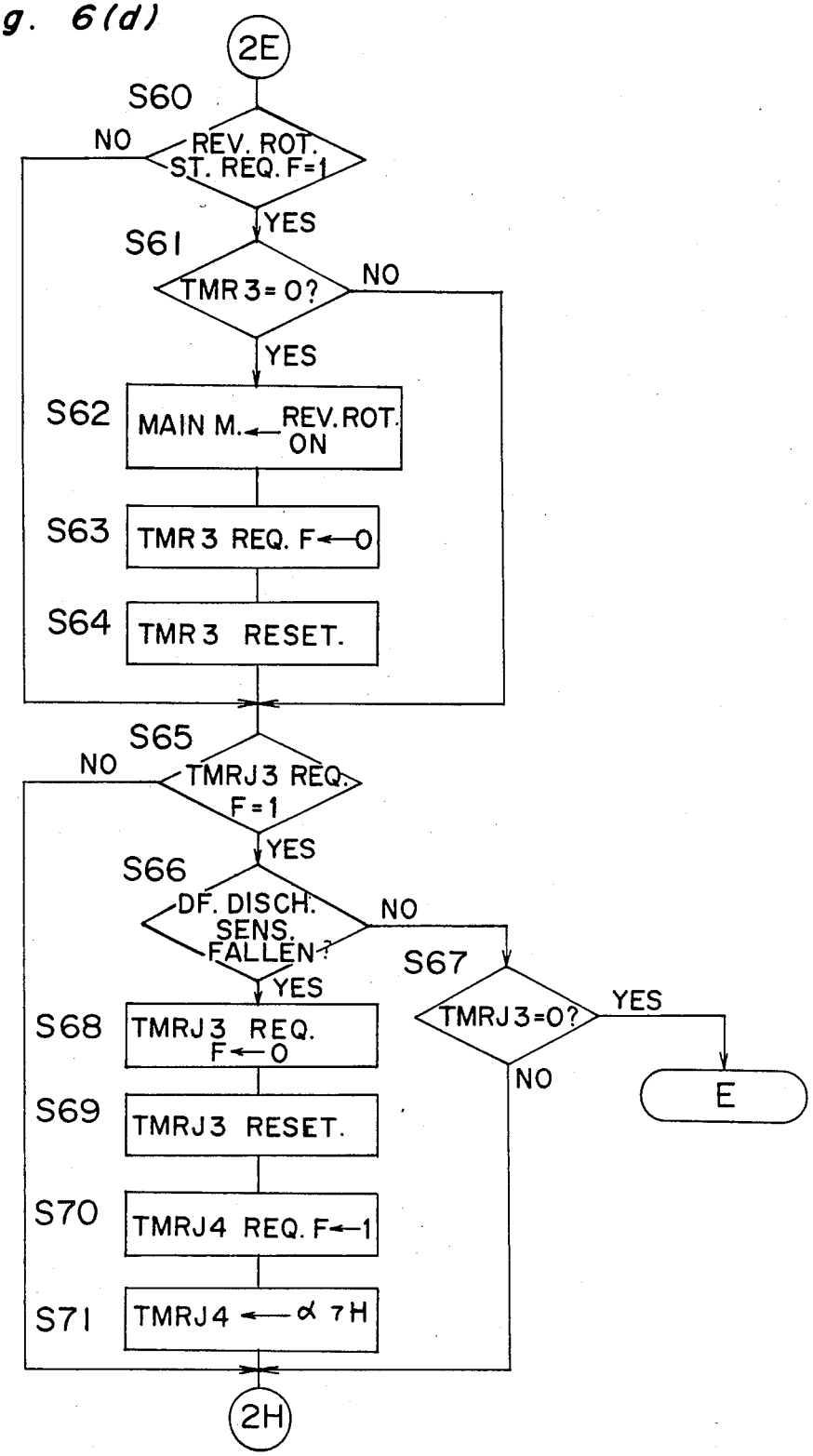
Figure 6E:
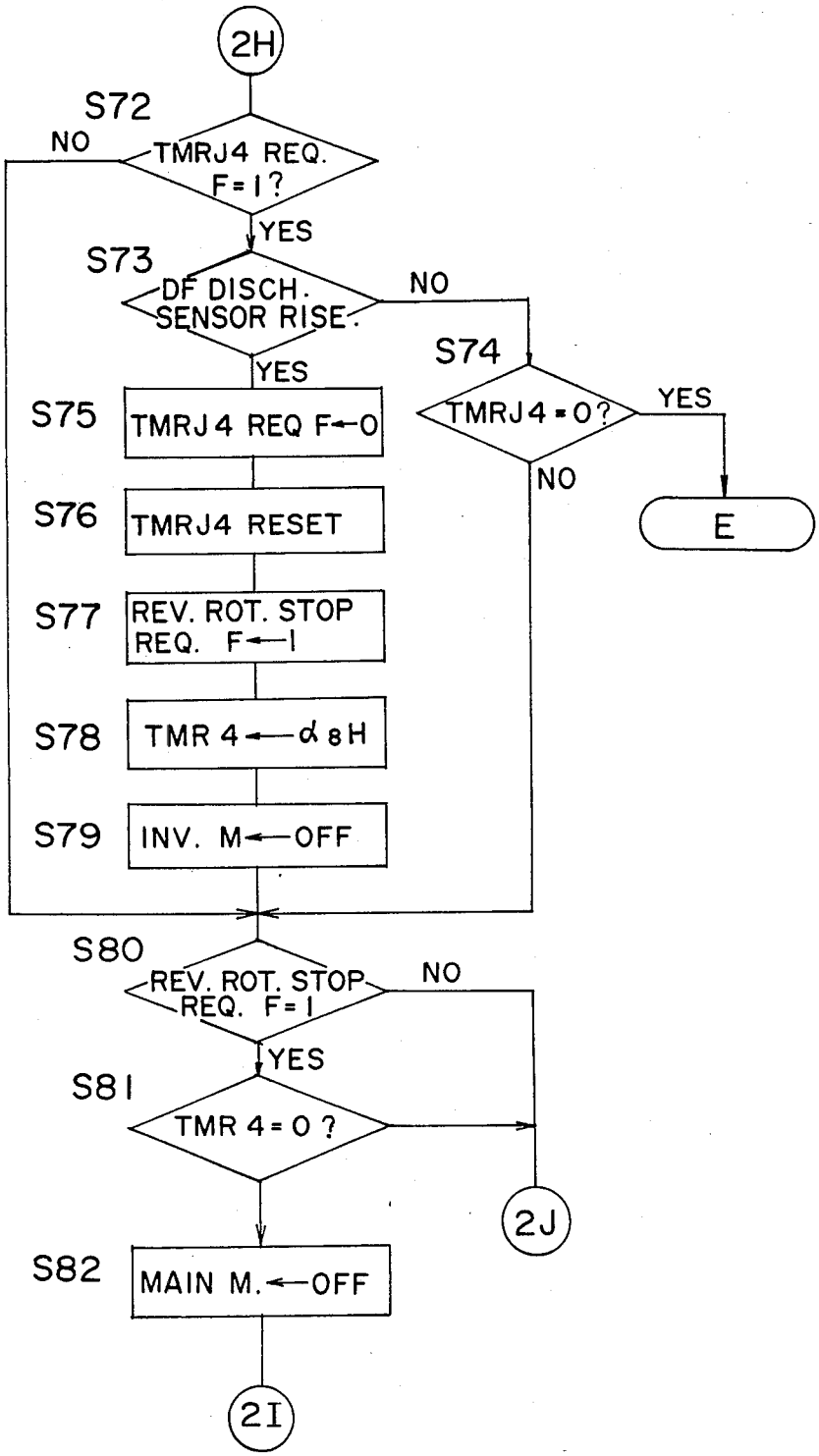
Figure 6F:
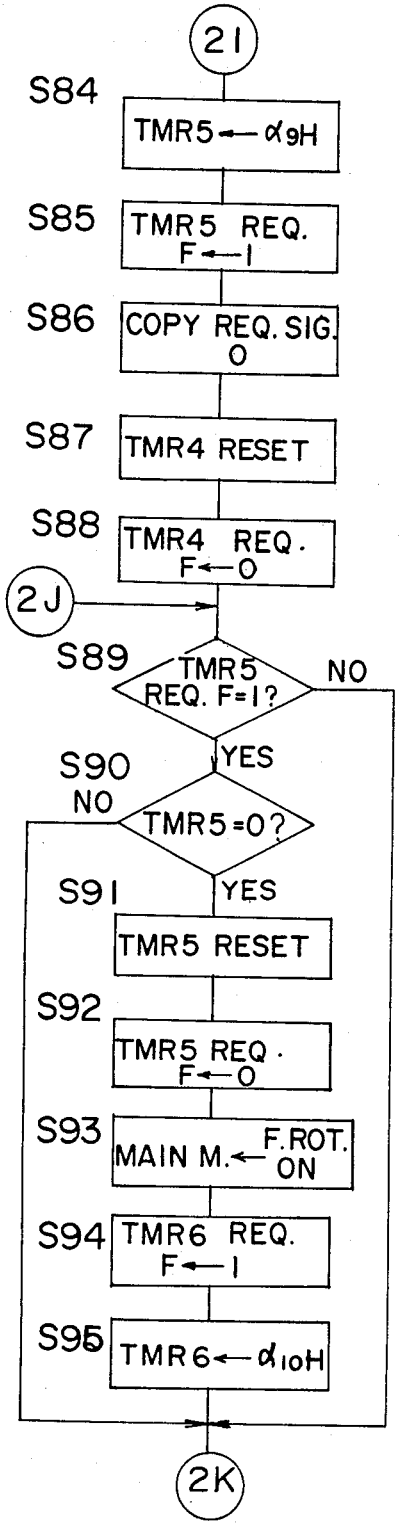
Figure 6G:
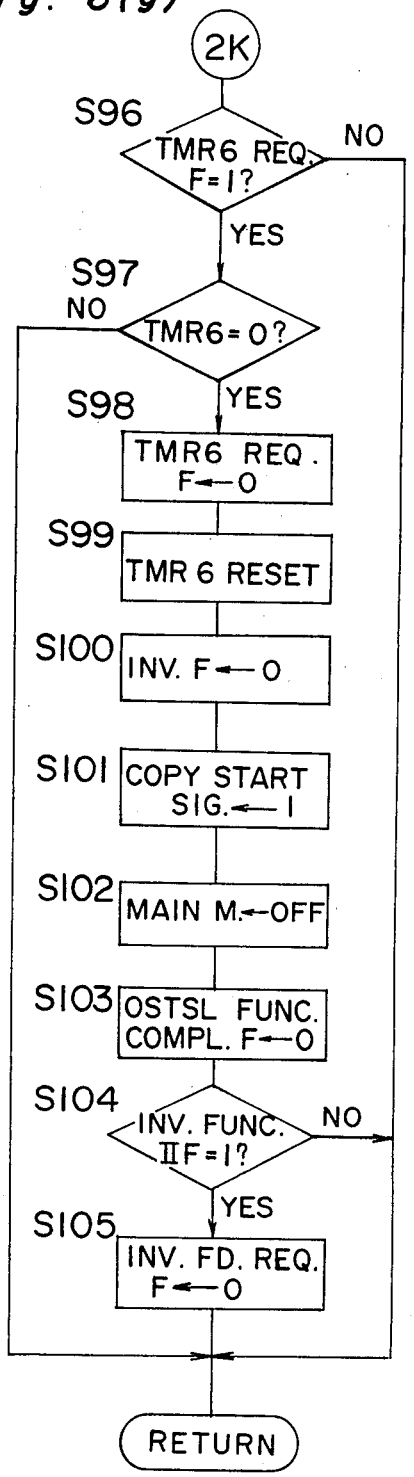
Figure 7A:
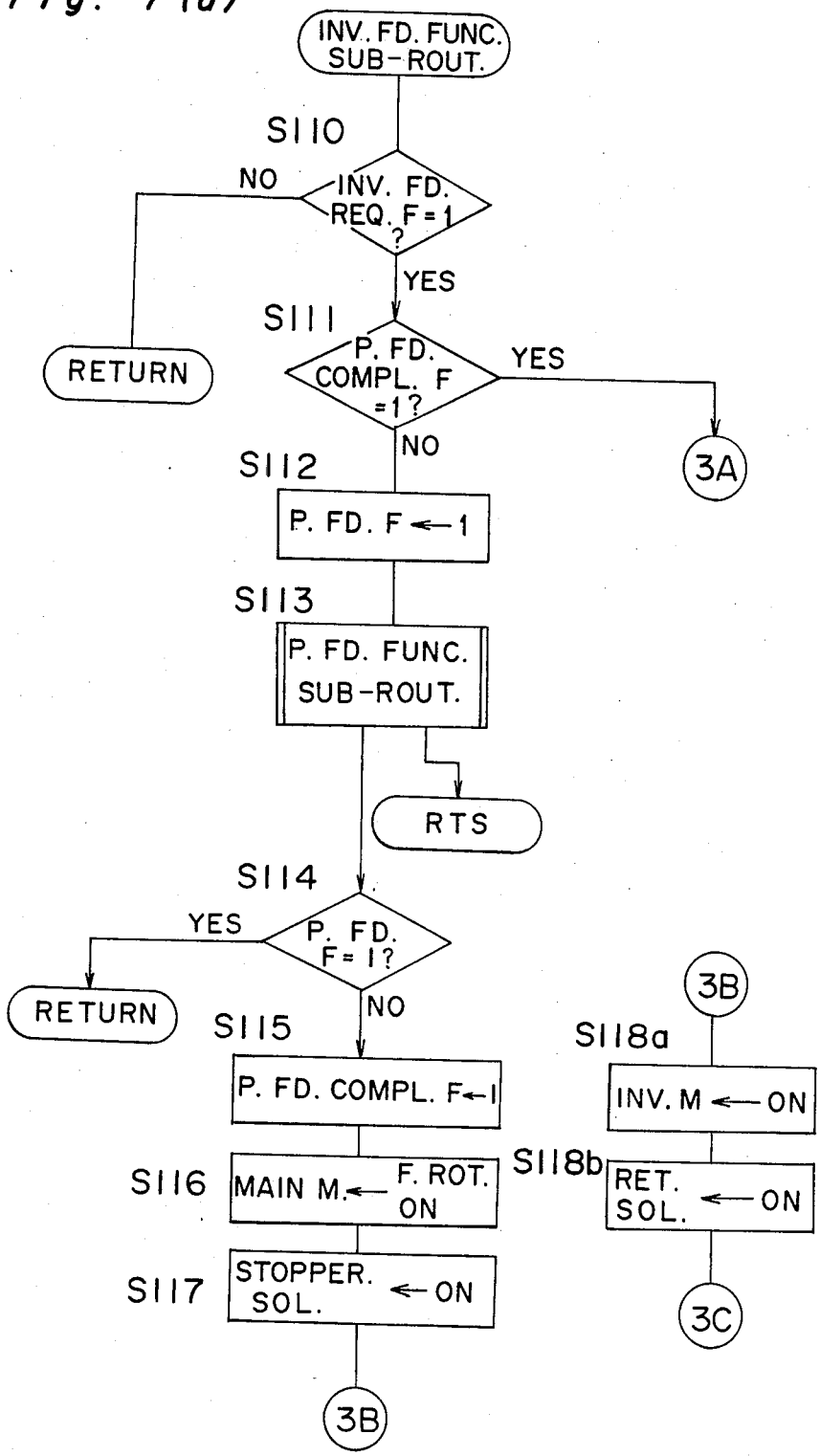
FIGS. 7(*a*) and 7(*b*) are a continuous flow-chart showing an inverting feeding function sub-routine at a step S15 in FIG. 5(*b*)
Figure 7B:
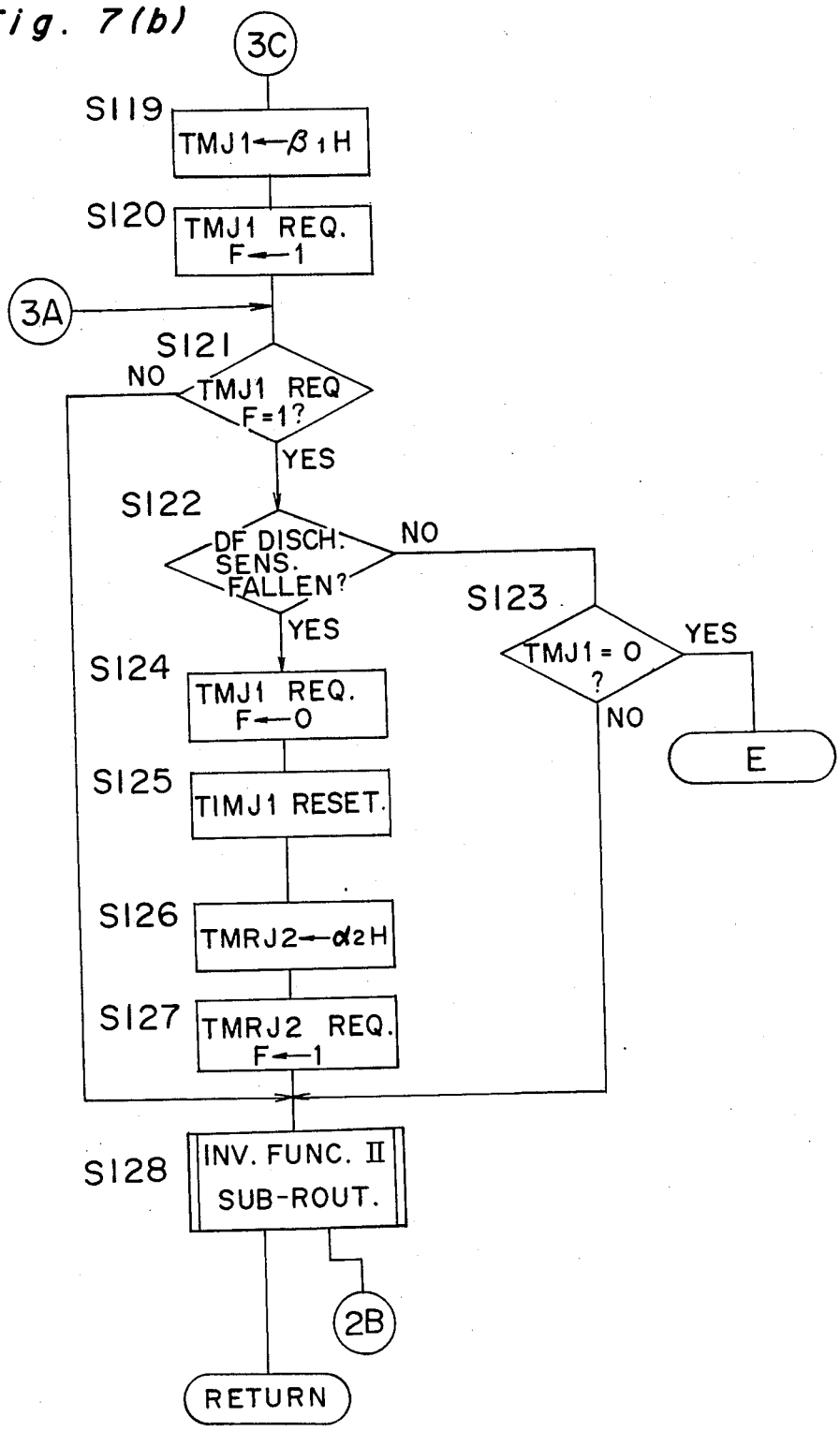

Hereinbelow, the inverting feeding function sub-routine in step S15 referred to earlier (FIG. 5(b)) will be explained with reference to FIGS. 7(*a*) and 7(*b*).

This sub-routine carries out such a control that in the case where a duplexed original document discharged onto the discharge tray 140 after being inverted upon input of the interruption signal during operation with respect to the reverse face thereof is fed again, and also in the case where a duplexed original document subjected to jamming in the above inverting function subroutine is taken out for re-feeding, the original document which is thus fed again face down, is caused to pass through the transport section 120 as it is so as to be inverted at the inverting section 130 for again returning to the transport section 120.

In the first place, at step S110, it is checked whether or not the inverting feeding request flag is "1". This inverting feeding request flag is set to "1" when paper jamming took place during the inverting feeding function (step S18), and also, when the interruption signal is applied as explained later in the abnormality check subroutine shown in FIG. 8 (step S139). If the judgement is "YES", it is checked at step S111 whether or not a paper feeding completion flag is "1". This paper feeding completion flag is to be set to "1" at the time point when the feeding of the original document reset after the jamming operation or the restoration from the interruption, has been completed. If the paper feeding completion flag is "0" at step S111, i.e., if the paper feeding has not been completed, the paper feeding function sub-routine is effected at step S113 after setting a paper feeding flag to "1" at step S112. In this sub-routine, the reset original document is fed to the transport section 120, and upon completion of the paper feeding, the paper feeding flag as described above is set to "0".

Subsequently, at step S114, it is judged whether or not the paper feeding flag is "1". Since the paper feeding flag has been reset to "0" at the sub-routine of step S113 upon completion of the paper feeding, the judgement is "NO". Thus, at step S115, the paper feeding completion flag is set to "1", and at step S116, the main motor is turned on for forward rotation so as to drive the transport belt 122 in the forward direction, while at step S117, the stopper solenoid is turned on, with simultaneous turning on of the inverting motor at step S118*a*, and at step S118*b*, the return solenoid in turned on. In other words, the original document fed again is caused to pass through as it is without being once stopped on the original document platform 19 for being inverted at the inverting section 130.

Incidentally, simultaneously with the starting of feeding of the original document, $\alpha_1$H is set in a timer TMJ1 at step S119, while at step S120, a TMJ1 request flag is set to "1". This timer TMJ1 is intended to check whether or not any paper jamming has taken place during movement of the leading edge of the original document to the discharge sensor Se4 from the sensor Se2.

Subsequently, at step S121, judgement is made as to whether or not the TMJ1 request flag is "1". Since the TMJ1 request flag has been set to "1" at step S120, the judgement is "YES". At step S122, it is checked whether or not the discharge sensor Se4 has fallen, i.e., whether or not the sensor Se4 has detected the leading edge of the re-fed original document. If the judgement is "NO", it is checked at step S123 whether or not the timer TMJ1 has been terminated. If said timer is terminated, it means that paper jamming has taken place before arrival at the sensor Se4, and therefore, the procedure is shifted to steps S17, S18 and S19 referred to earlier.

When the leading edge of the original document is detected by the sensor Se4 before termination of the timer TMJ1 ("YES" at step S122), the TMJ1 request flag is reset to "0" at step S124, while at step S125, the timer TMJ1 is reset. Simultaneously, at step S126, $\alpha_2$H is set in a timer TMJ2, and at step S127, a TMRJ2 request flag is set to "1", and further, at step S128, an inverting function II sub-routine is executed.

This inverting function II sub-routine is intended to execute the operation after step S42 of the inverting function sub-routine referred to earlier, and the re-fed original document is turned over between its front and reverse faces so as to be set on the original document platform 19. Upon completion of setting of the original document, the inverting feeding request flag is reset at step S105. Accordingly, with respect to the original document after the second sheet subsequent to restoration from the paper jamming or restoration from the interruption, judgement is "NO" at step S110 to revert to the main routine, and the above inverting feeding sub-routine is not effected.

Figure 8A:
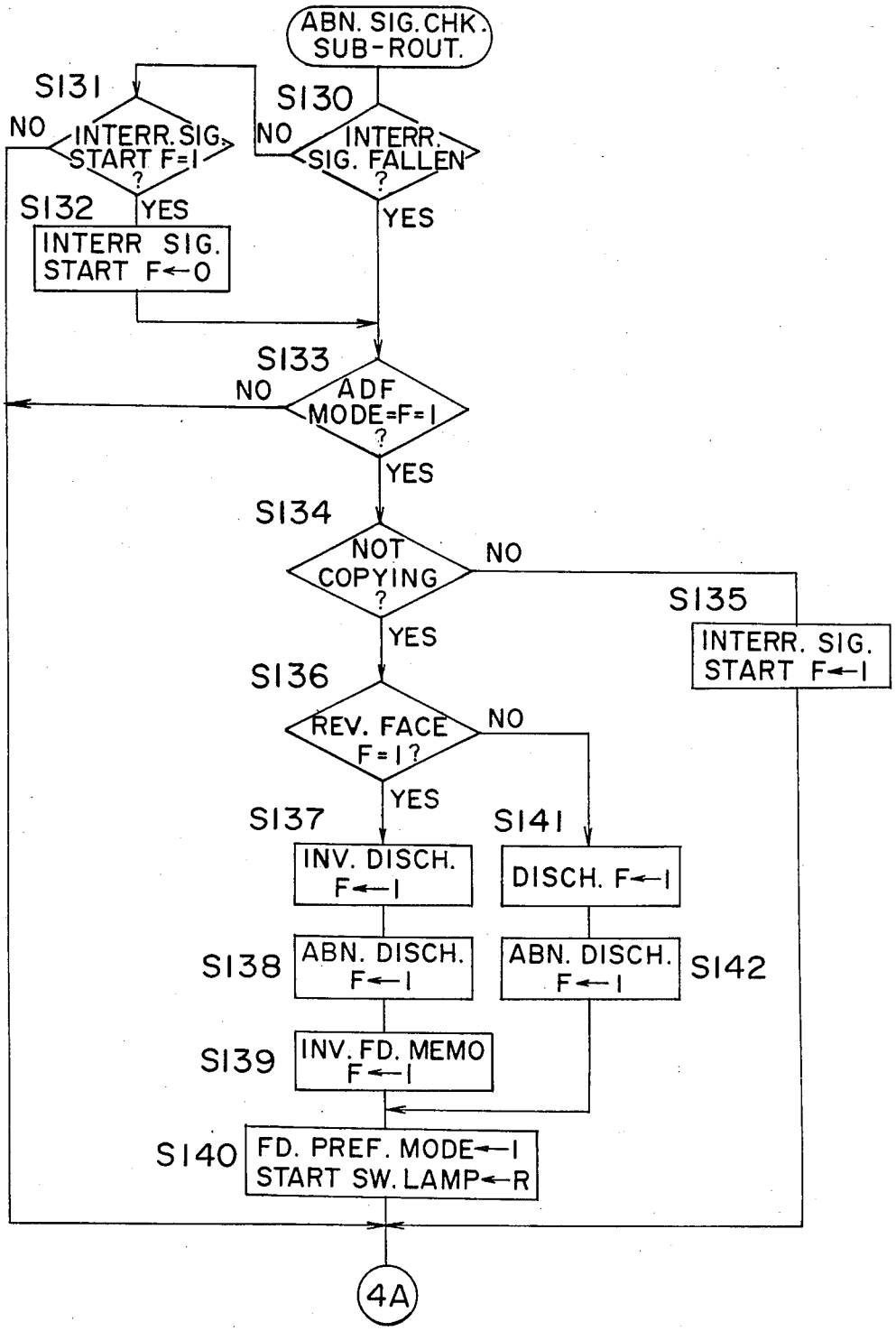
FIGS. 8(*a*) and 8(*b*) are a continuous flow-chart showing an abnormal signal check sub-routine at a step S10 in FIG. 5(*a*)
Figure 8B:
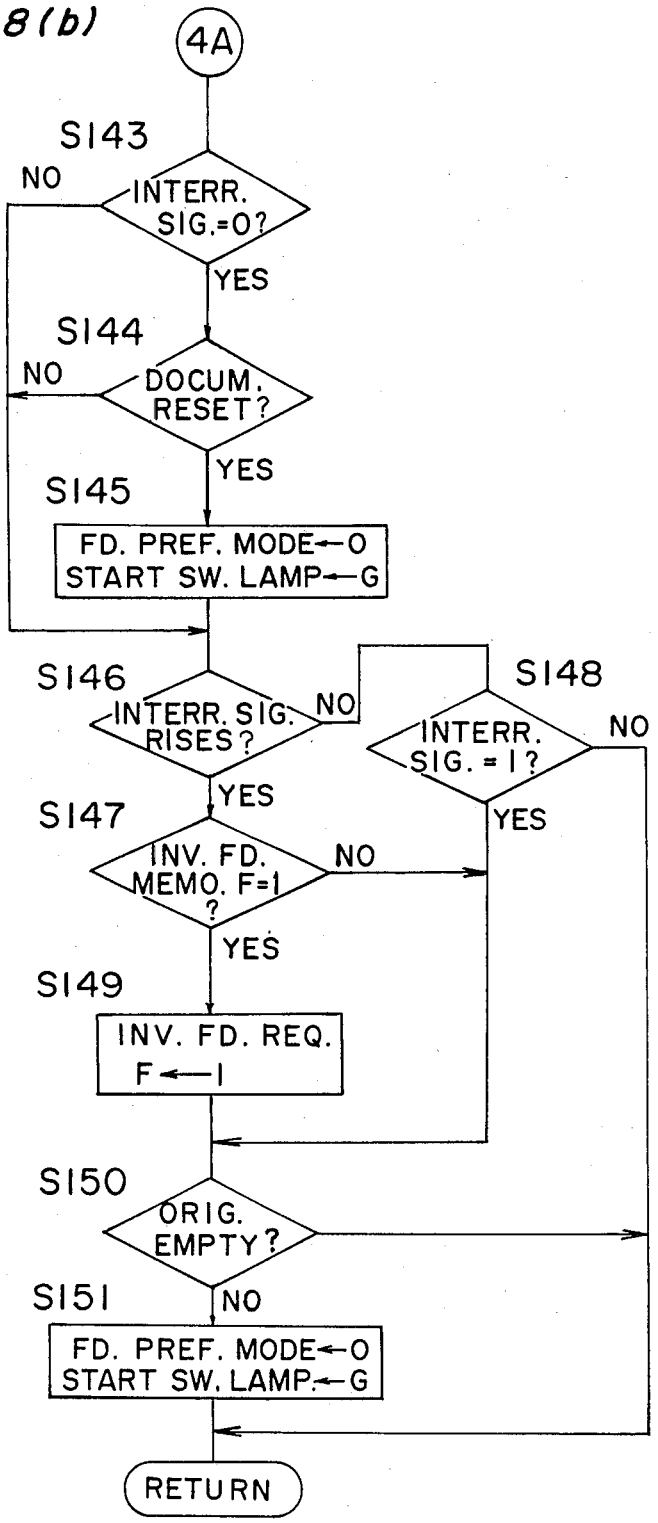

Referring further to FIGS. 8(*a*) and 8(*b*) which are continuous, the abnormal signal check sub-routine at step S10, i.e., the control of the interruption copying will be described in detail hereinbelow.

In the first place, at step S130, it is checked whether or not the interruption signal has fallen. The interruption signal is transmitted from the micro-computer CPU1 of the copying apparatus 1 to the micro-computer CPU2 of the automatic document feeding device 100 based on the on/off operation of the interruption key 77, and is caused to fall at the first turning on of the interruption key 77, and to rise at the second turning on thereof. If the falling of the interruption signal is not ensured (i.e., judgement is "NO" at step S130), it is checked at step S131 whether or not an interruption signal start flag is "1". If the judgement is "YES", the interruption signal start flag is reset to "0" at step S132 and the procedure is shifted to step S133. This interruption signal start flag is intended to be reset at step S135 (to be described later) when the interrupting key 77 is turned on during copying function so as to effect the interrupting operation subsequent to the completion of the copying function.

When the falling of the interruption signal is ensured at step S130 referred to earlier, it is checked at step S133 whether or not the ADF mode flag is "1".

If the judgement is "YES" at the above step S133, i.e., if the copying function to effect the feeding of the original document by the automatic document feeding device 100 has been selected, it is judged at step S134 whether or not the copying is under way. If the copying is being effected, the interruption signal start flag is set to "1" at step S135. Meanwhile, if the copying is not under way, it is checked at step S136 whether or not reverse face flag is "1". This reverse face flag is adapted to be set at the time point when the copying for the front face of the original document located on the original document transport section 120 is completed in the duplexed original document mode, and to be reset when the copying for the reverse face thereof is completed.

If the reverse face flag is "1", an inverting discharge flag is set to "1" at step S137, and an abnormal discharge flag is set to "1" at step S138, and further, at step S139, an inverting feeding memory flag is set to "1". The above inverting discharge flag is to instruct the control for inverting the original document located at the transport section 120, in the inverting section 130 for discharge, and the abnormal discharge flag is intended to instruct the control for directly discharging the subsequent original document standing-by at the paper feeding section 110 without being inverted, while the inverting feeding memory flag is intended to memorize that the interruption is effected during the reverse face copying operation, and to cause the original document feeding function after releasing of the interruption to start from the inverting feeding (FIG. 7, step S15).

Subsequently, at step S140, the feeding preferential mode signal is set to "1", while the red lamp of the start switch SW of the automatic document feeding device 100 is lit. When set to "1", the feeding preferential mode signal inhibits starting of the automatic document feeding device 100 by the start switch SW, and simultaneously, makes it possible to start the copying by the print switch 70, while, when reset to "0", said feeding preferential mode signal allows the starting of the automatic document feeding device 100 by the start switch SW, and also, inhibits the starting of copying by the print switch 70.

On the other hand, when the judgement is "NO" at said step S136, i.e., if the front face of an original document located at the original document transport section 120 is being copied when the interruption signal is inputted, a discharge flag is set to "1" at step S141, while at step S142, the abnormal discharge flag is set to "1". This discharge flag is intended to instruct the control for directly discharging the original document located at the discharging section without being inverted.

By executing the foregoing routine, the original documents located at the transport section 120 under the front face copying state are discharged as they are, while those under the reverse faces copying state are discharged as inverted, with the front face directed downwards in both cases, and the subsequent original documents standing-by at the paper feeding section 110 are also directly discharged as they are, with the front faces directed downwards.

Next, at step S143, it is checked whether or not the interruption signal is "0", i.e., whether or not the interruption is being effected. If the judgement is "NO", the procedure is shifted to step S146, while if the judgement is "YES", judgement is made at step S144 as to whether or not the interrupting original document has been set on the paper feeding tray 111. If the original document has been set, the feeding preferential mode signal is reset to "0" at step S145, while the green lamp for the start switch SW of the automatic document feeding device 100 is lit. In other words, it is made possible to effect the interrupting copying through employment of the automatic feeding device 100.

Subsequently, at step S146, it is judged whether or not the interruption signal rises, i.e., whether or not the interrupting copying is released. If the judgement is "YES", it is checked at step S147, whether or not the inverting feeding memory flag is "1". If the inverting feeding memory flag is set at step S139, the judgement is "YES", and at step S149, the inverting feeding request flag is reset to "1". Accordingly, with respect to the first original document after releasing of the interruption during the reverse face copying, the inverting feeding function sub-routine is effected, and the document is set at the exposure position through inversion between front and reverse faces.

On the other hand, when it is found at step S148 that the interrupting signal is "1", i.e., that the interruption has already been released, the procedure is shifted to step S150 without executing steps S147 and S149, and if it is found at step S148 that the interrupting signal is "0", i.e., that the interrupting state is still present, immediate returning is effected.

Successively, at step S150, it is judged whether or not the original document at the paper feeding section 110 is of "empty". If the judgement is "NO", i.e., if the original document is set at the paper feeding section 110, the feeding preferential mode signal is reset to "0" at step S151, and the green lamp of the start switch SW for the automatic document feeding device is lit. In other words, it is made possible to effect the copying through employing of the automatic original document feeding device 100.

Hereinbelow, the sub-routine for the copying control will be described with reference to FIG. 9.

In the first place, at step S160, it is judged whether or not the feeding preferential mode signal is "0". If the judgement is "YES", the red print lamp for the print switch 70 is lit at step S161, and when it is found at step S162 that the copying start signal from the automatic document feeding device 100 has been set to "1", the copying function is effected at step S163. Meanwhile, when the feeding preferential mode signal is "1", and the judgement is "NO" at step S160, the green print lamp of the print switch 70 is lit at step S164, and when the turning on of the print switch 70 is ensured at step S165, the copying function is executed at step S163.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A copying apparatus equipped with an automatic document feeding device which feeds original documents, one sheet by one sheet, from a first accommodating means for holding the original documents to be copied so as to set a first face of said original document at an exposing position and, after the exposing operation for said first face, to set a second face thereof at the exposing position by inverting said original document, and after the exposing operation for the second face, to feed said original document from the exposing position to a second accommodating means for holding the original documents after the exposing operation, said copying apparatus comprises: means for inputting an interrupting instruction for suspending the original document feeding operation being presently executed in order to effect an interrupting operation; and an original document discharging means which discharges, upon input of the interrupting instruction, the original document present in the original document feeding means in such a manner that the state of accommodation of the original document in said second accommodating means becomes the same irrespective of stages of the operating state of the original document feeding means.

2. A copying apparatus equipped with an automatic document feeding device, which comprises:

a first accommodating means for holding original documents to be copied;

an original document feeding mens for feeding the original documents one sheet by one sheet from said first accommodating means so as to set a first face of said original document at an exposing position;

an original document discharging means for discharging the original document at the exposing position;

an original document inverting means for inverting the original document so as to set a second face of said original document at the exposing position;

a second accommodating means for holding the original documents discharged by said discharge means after the exposing operation;

means for inputting an interrupting instruction for suspending the original document feeding operation being presently executed in order to effect an interrupting operation; and control means for controlling said discharging means and said inverting means according to timing by which said interrupting instruction was inputted so as to discharge the original document in such a manner that the state of accommodation of the original document in said second accommodating means becomes the same irrespective of stages of the operating state of the original document feeding means upon the timing.

3. A coping apparatus as claimed in claim 2, wherein the original document, the operation for the first face thereof being executed, is discharged by said discharging means under the control of said control means in accordance with the interrupting instruction.

4. A copying apparatus as claimed in claim 2, wherein the original document, the operation for the second face thereof being executed, is discharged by said discharging means after inverting the original document by said inverting means under the control of said control means in accordance with the interrupting instruction.

5. A copying apparatus equipped with an automatic document feeding device which feeds original documents, one sheet by one sheet, from a first accommodating means for holding the original documents to be copied so as to set a first face of said original document at an exposing position and, after the exposing operation for said first face, to set a second face thereof at the exposing position by inverting said original document, and after the exposing operation for the second face, to feed said original document from the exposing position to a second accommodating means for holding the original documents after the exposing operation, said copying apparatus comprises: means for inputting an interrupting instruction for suspending the original document feeding operation being presently executed in order to effect an interrupting operation;

a memory means for storing timing by which said interrupting instruction was inputted;

an original document discharging means which discharges, upon input of the interrupting instruction, the original document present in the original document feeding means in such a manner that the state of accommodation of the original document in said second accommodating means becomes the same irrespective of stages of the operating state of the original document;

means for inputting a releasing instruction for releasing the interrupting operation; and a control means which controls, upon input of the interruption releasing instruction, the original document feeding mode for a first original document after interruption restoration, according to the stored content of said memory means.

6. A copying apparatus equipped with an automatic document feeding device, which comprises:

a first accommodating means for holding original documents to be copied;

an auxiliary original document feeding means for feeding the original documents, one sheet by one sheet from said first accommodating means to a waiting position;

an original document feeding means which feeds the original document from said waiting position so as to set a first face of the original document at an exposing position and, after the exposing operating for the first face, to set a second face thereof at the exposing position by inverting the original document, and after the exposing operation for the second face, to feed the original document from the exposing position;

a second accommodating means for holding the original documents after the exposing operation, means for inputting an interrupting instruction for suspending the original document feeding operation being presently executed in order to effect an interrupting operation; and an original document discharging means which discharges upon input of the interrupting instruction, the original documents present in the original document feeding means and in the waiting position in such a manner that the state of accommodation of the original document in said second accommodating means becomes the same irrespective of stages of the operating state of said original document feeding means.

7. A copying apparatus as claimed in claim 6, wherein said original document discharging means discharges the original document which is being executed in an operation on the first face thereof, in accordance with the interrupting instruction.

8. A copying apparatus as claimed in claim 6, wherein said original document discharging means discharges the original document which is being in an operation on the first face thereof, after inverting the original document.

9. A copying apparatus as claimed in claim 7, wherein said original document discharging means immediately commences to discharge the original document in the waiting position following the discharge operation for the original in said original document feeding means.

10. A copying apparatus as claimed in claim 8, wherein said original document discharging means discharges the original document in the waiting position following the discharging operation for the original document in said original document feeding means.

11. In an improved automatic duplex copier having a document feeder, transport means for positioning a document to be copied; means for exposing the positioned document and producing a copy of the document, means for inverting a document from a first to a second surface to return it to the exposing means for copying the other side of the document and means for receiving a discharged document after a copying operation, the improvement comprising:

means for monitoring the position of the document in the copying operation and storing information relating to the document position upon any interruption of a copying cycle of the document;

control means for directing the transport means to transport the document that was subject to the interruption, after a resubmission of the document to the document feeder, to the correct position relative to the means for exposure and relative to the desired side of the document to be copied in response to the stored information in the monitor means, and sensor means, cooperating with the control means to monitor the movement of the resubmitted document from the document feeder directly to the means for inverting to insure that the document has not jammed during transportation to position its second surface at the exposing means to complete the copying cycle when the copying operation was interrupted after copying of the first surface.

12. A copying apparatus equipped with an automatic document feeding device which feeds original documents, one sheet by one sheet, from a first accommodating means for holding the original documents to be copied so as to set a first face of said original document at an exposing position and, after the exposing operation for said first face, to set a second face thereof at the exposing position by inverting said original document, and after the exposing operation for the second face, to feed said original document from the exposing position to a second accommodating means for holding the original documents after the exposing operation, said copying apparatus comprises:

means for inputting an interruption instruction for suspending an exposing operation being executed in order to effect an interrupting operation; and an original document discharging means which discharges, upon input of the interrupting instruction, the original document present in the original document feeding means in such a manner that the state of accommodation of the original document in said second accommodating means becomes the same, irrespective of the operating state of the original document feeding means.

13. A copying apparatus equipped with an automatic document feeding device, which comprises:

a first accommodating means for holding original documents to be copied;

an original document feeding means for feeding the original documents, one sheet by one sheet, from said first accommodating means so as to set a first face of said original document at an exposing position for reproduction;

an original document discharging means for discharging the original document from said exposing position;

an original document inverting means for inverting the original document so as to set a second face of said original document at said exposing position;

a second accommodating means for holding the original documents discharged by said discharge means after the exposing operation;

means for forming the image of the original document at the exposure position on a copy sheet;

means for inputting an interrupt instruction for suspending the image forming operation being presently executed in order to effect an interrupting operation; and control means for controlling said discharging means and said inverting means according to a time period at which said interrupting instruction was input so as to discharge the original document in such a manner that the state of accommodation of the original document in said second accommodating means becomes the same, irrespective of the operating state of the original document feeding means at that time period.

14. A copying apparatus as claimed in claim 13, wherein the original document, the operation for the first face thereof being executed, is discharged by said discharging means under the control of said control means in accordance with the interrupting instruction.

15. A copying apparatus as claimed in claim 13, wherein the original document, the operation for the second face thereof being executed, is discharged by said discharging means after inverting the original document by said inverting means under the control of said control means in accordance with the interrupting instruction.

16. A copying apparatus equipped with an automatic document feeding device which feeds original documents, one sheet by one sheet, from a first accommodating means for holding the original documents to be copied so as to set a first face of said original document at an exposing position for reproduction and, after the exposing operation for said first face, to set a second face thereof at the exposing position by inverting said original document, and after the exposing operation for the second face, to feed said original document from the exposing position to a second accommodating means for holding the original documents after the exposing operation, said copying apparatus comprises:

means for inputting an interrupting instruction for suspending an exposing operation being presently executed in order to effect an interrupting operation;

a memory means for storing a signal representative of the state of operation when said interrupting instruction was input;

an original document discharging means which discharges, upon input of the interrupting instruction, the original document present in the original document feeding means in such a manner that the state of accommodation of the original document in said second accomodating means becomes the same, irrespective of the stages of the operating stage on the original document;

means for inputting a releasing instruction for releasing the interrupting operation; and a control means which controls, upon input of the interruption releasing instruction, the original document feeding mode for a first original document after interruption restoration, according to the stored content of said memory means.

17. A copying apparatus equipped with an automatic document feeding device, which comprises:

a first accommodating means for holding original documents to be copied;

an auxiliary original document feeding means for feeding the original documents, one sheet by one sheet from said first accommodating means to a waiting position;

an original document feeding means which feeds the original document from said waiting position so as to set a first face of the original document at an exposing position for reproduction and, after the exposing operation for the first face, to set a second face thereof at the exposing position by inverting the original document, and after the exposing operation for the second face, to feed the original document from the exposing position;

a second accommodating means for holding the original documents after the exposing operation;

means for forming an image of the original document at the exposure position on a copy sheet;

means for inputting an interrupting instruction for suspending the image forming operation being presently executed in order to effect an interrupting operation; and an original document discharging means which discharges, upon input of the interrupting instruction, the original documents present in the original document feeding means and in the waiting position in such a manner that the state of accommodation of the original document in said second accommodating means becomes the same, irrespective of the operating state of said original document feeding means.

18. A copying apparatus as claimed in claim 17, wherein said original document discharging means discharges the original document which is being executed in an operation on the first face thereof, in accordance with the interrupting instruction.

19. A copying apparatus as claimed in claim 18, wherein said original document discharging means discharges the original document which is being executed in an operation on the first face thereof, after inverting the original document.

20. A copying apparatus as claimed in claim 18, wherein said original document discharging means discharges the original document in the waiting position following the discharge operation for the original in said original document feeding means.

21. A copying apparatus as claimed in claim 19, wherein said original document discharging means discharges the original document in the waiting position following the discharging operation for the original document in said original document feeding means.

* * * * *